US009770746B2

(12) United States Patent
Ishii et al.

(10) Patent No.: US 9,770,746 B2
(45) Date of Patent: Sep. 26, 2017

(54) ROLLING APPARATUS FOR FLAT-ROLLED METAL MATERIALS

(71) Applicant: NIPPON STEEL & SUMITOMO METAL CORPORATION, Tokyo (JP)

(72) Inventors: Atsushi Ishii, Tokyo (JP); Daisuke Kasai, Tokyo (JP); Shigeru Ogawa, Tokyo (JP); Hiroki Kato, Tokyo (JP); Yuuto Okabe, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 469 days.

(21) Appl. No.: 14/351,074

(22) PCT Filed: Jun. 25, 2013

(86) PCT No.: PCT/JP2013/067408
§ 371 (c)(1),
(2) Date: Apr. 10, 2014

(87) PCT Pub. No.: WO2014/003016
PCT Pub. Date: Jan. 3, 2014

(65) Prior Publication Data

US 2014/0283573 A1 Sep. 25, 2014

(30) Foreign Application Priority Data

Jun. 26, 2012 (JP) ..... 2012-143454

(51) Int. Cl.
*B21B 38/06* (2006.01)
*B21B 38/08* (2006.01)
(Continued)

(52) U.S. Cl.
CPC ..... *B21B 38/06* (2013.01); *B21B 1/00* (2013.01); *B21B 38/08* (2013.01);
(Continued)

(58) Field of Classification Search
CPC ..... B21B 37/58; B21B 37/62; B21B 37/64; B21B 38/08; B21B 38/10; B21B 2265/12;
(Continued)

(56) References Cited

U.S. PATENT DOCUMENTS 5,806,360 A * 9/1998 Dumas ..... B21B 13/023 72/238
2006/0230799 A1 10/2006 Ogawa et al.
(Continued)

FOREIGN PATENT DOCUMENTS

CN 1761540 A 4/2006
DE 1527618 A1 * 1/1970 ..... B21B 31/02
(Continued)

OTHER PUBLICATIONS

Extended European Search Report, dated Jun. 1, 2015, for European Application No. 13810177.9.
(Continued)

*Primary Examiner* — James S McClellan
*Assistant Examiner* — Peter Iannuzzi
(74) *Attorney, Agent, or Firm* — Birch, Stewart, Kolasch & Birch, LLP

(57) ABSTRACT

[Object]
To provide a rolling apparatus capable of accurately detecting a rolling direction force applied to a work roll chock.
[Solution]
A rolling apparatus for flat-rolled metal materials including a pair of upper and lower work rolls 1 and 2 includes a pair of work roll chocks 5 and 6 configured to hold the respective work rolls 1 and 2, housings 10 configured to hold the work roll chocks, and rolling direction force measurement devices 21, 22, 23, and 24 configured to measure rolling direction forces. The rolling direction force measurement devices include a plurality of load detection devices on an entry side
(Continued)

or an exit side of the work roll chocks in a rolling direction, and the plurality of load detection devices are provided to one of the housings, and the plurality of load detection devices are disposed in a manner that, during rolling of the flat-rolled metal materials, at least two of the load detection devices are arranged adjacent to each other in a draft direction facing a side surface of a corresponding one of the work roll chocks. In this case, the at least two load detection devices are disposed in a manner that a line extending in the rolling direction and including a roll axis, which is a point of effort of a rolling direction force, is interposed between the at least two load detection devices in the draft direction.

15 Claims, 17 Drawing Sheets

(51) Int. Cl.
*B21B 31/02* (2006.01)
*B21B 1/00* (2006.01)
*B21B 13/02* (2006.01)
*B21B 31/20* (2006.01)

(52) U.S. Cl.
CPC ... *B21B 2013/025* (2013.01); *B21B 2013/028* (2013.01); *B21B 2031/206* (2013.01); *B21B 2265/12* (2013.01); *B21B 2273/04* (2013.01)

(58) Field of Classification Search
CPC . B21B 2271/02; B21B 38/06; B21B 2273/04; B21B 31/02; B21B 38/00
USPC ..... 72/10.4, 21.4
See application file for complete search history.

(56) References Cited

U.S. PATENT DOCUMENTS

| | | | | |
|---|---|---|---|---|
| 2009/0151413 | A1 | 6/2009 | Ogawa et al. | |
| 2012/0000543 | A1 * | 1/2012 | Keintzel | F15B 21/008 137/12 |
| 2013/0000371 | A1 * | 1/2013 | Kasai | B21B 38/105 72/10.4 |

FOREIGN PATENT DOCUMENTS

| | | | | |
|---|---|---|---|---|
| DE | 2757701 | A1 * | 7/1978 | B21B 38/06 |
| DE | 3811875 | A1 * | 4/1989 | B21B 31/02 |
| DE | 3807654 | A1 * | 9/1989 | B21B 31/02 |
| DE | CA 2575328 | A1 * | 12/2006 | B21B 31/02 |
| EP | 1607149 | A1 | 12/2005 | |
| GB | 1544754 | A * | 4/1979 | B21B 38/10 |
| JP | 58-218326 | A | 12/1983 | |
| JP | EP 0685273 | A1 * | 12/1995 | B21B 13/08 |
| JP | WO 0112353 | A1 * | 2/2001 | B21B 13/023 |
| JP | WO 0164360 | A1 * | 9/2001 | B21B 31/02 |
| JP | CA 2392114 | A1 * | 2/2003 | B21B 31/02 |
| JP | 2006-82118 | A | 3/2006 | |
| JP | 2007-260775 | A | 10/2007 | |
| JP | 2008-161934 | A | 7/2008 | |
| JP | 2009-208151 | A | 9/2009 | |
| JP | WO 2011129453 | A1 * | 10/2011 | B21B 37/58 |
| JP | 2012-148339 | A | 8/2012 | |
| SU | 814498 | A1 * | 3/1981 | B21B 31/02 |
| WO | WO 2004/082860 | A1 | 9/2004 | |
| WO | WO 2011/129453 | A1 | 10/2011 | |

OTHER PUBLICATIONS

Chinese Office Action for Chinese Application No. 201380003802.1, dated Dec. 29, 2014, with a partial English translation.
International Search Report issued in PCT/JP2013/067408 dated Sep. 3, 2013.
Written Opinion of the International Searching Authority issued in PCT/JP2013/067408 dated Sep. 3, 2013.

* cited by examiner

ROLLING APPARATUS FOR FLAT-ROLLED METAL MATERIALS

TECHNICAL FIELD

The present invention relates to a rolling apparatus for flat-rolled metal materials.

BACKGROUND ART

In a rolling process of a flat-rolled metal material, it is very important to roll a sheet material in a form free from camber, or in a form not having bend in the left-right direction, in order to avoid not only a plane shape defect and a dimensional accuracy defect of the rolled material but also to avoid sheet pass troubles such as a zigzag movement and a tail crash.

Further, a warp that occurs at the time of rolling a sheet material also has a large influence on productivity of products, such as reduction in rolling efficiency and increase in the number of refining processes. For example, as for the refining processes, there are cases where it is necessary to correct camber or a warp using a leveler or by performing pressing or the like, and in an extreme case, a defect part may have to be cut. Still further, in the case where camber or a warp occurred to a large extent, the rolling facility may be damaged due to the collision of the sheet. In this case, it is not only that the sheet itself loses the product value, but that it brings about tremendous damages such as production interruption and repairing of the rolling facility.

In addition, in order to control the above camber with high accuracy, it is also important to perform an initial setting called zero point adjustment. The zero point adjustment is performed as follows: kiss-roll tightening is conducted by operating a screw down device in a roll-rotating state; and, a point in which a measurement value of a rolling load corresponding to a preset zero point adjustment load (preset to rated load of 15% to 85%) is set as a zero point of a reduction position, and the reduction position is set as a starting point (reference) in reduction control. In this case, the difference between left and right reduction positions, that is, the zero point of reduction leveling is often adjusted simultaneously. Also, as for the zero point adjustment of the reduction leveling, the measurement values of the rolling load on the time of kiss-roll tightening on the operator side and the driving side are adjusted such that the measurement values correspond to the preset zero point adjustment load. Note that the kiss-roll tightening means that, under the state that a rolled material is not present, the upper and lower work rolls are brought into contact with each other and a load is applied between the rolls.

Incidentally, to simplify expressions, the operator side and the driving side of the rolling mill, as the right and left sides when the rolling mill is seen from the front of the rolling direction, will be referred to as "right and left", respectively.

In view of the problems attributed to such camber, Patent Document 1 suggests a rolling method and a rolling apparatus capable of stably producing a flat-rolled metal material free from camber or having an extremely light camber. Specifically, in the rolling method and the rolling apparatus described in Patent Document 1, a load detection device measures a rolling direction force acting on roll chocks on an operator side and a driving side of a work roll, and a calculation device calculates a difference of the rolling direction forces between the operator side and the driving side. Then, a control device controls a left-right swivelling component of a roll gap of a rolling mill such that the difference becomes zero.

In view of the problem of a warp, Patent Document 2 suggests a rolling method and a rolling apparatus capable of stably producing a flat-rolled metal material having an extremely light warp. Specifically, in the rolling method and the rolling apparatus described in Patent Document 2, load detection devices provided on both entry side and exit side of upper and lower roll chocks of work rolls measure rolling direction forces acting on the upper and lower work roll chocks. Then, a calculation device calculates a difference between the rolling direction force on the upper side and the rolling direction force on the lower side, that is, an upper and lower rolling direction force difference. After that, upper and lower asymmetric components of the rolling apparatus is controlled such that the upper and lower rolling direction force difference is decreased.

In view of the problem of zero point adjustment, in Patent Document 3, it is discovered that a rolling direction force occurs even with zero point adjustment by the kiss roll state, pointed out that the rolling direction force does not affect a roll thrust force, and accordingly, there is proposed a method enabling more precise initial reduction position adjustment (reduction zero point adjustment) of a rolling mill.

Further, in order to produce a flat-rolled metal material free from camber, in a rolling method and a rolling apparatus described in Patent Document 4, rolling direction forces acting on roll chocks on an operator side and a driving side of a work roll are measured, a difference of the rolling direction forces between the operator side and the driving side is calculated, a left-right swivelling component of a roll gap of the rolling mill is controlled by using control gain such that the difference become a control target value, and the control gain is changed depending on a condition during rolling.

Still further, Patent Document 5 suggests a rolling mill and a rolling method capable of producing a flat-rolled metal material free from camber or warp, achieving zero point adjustment with high accuracy, and easily achieving application of a strong roll bending force. In the rolling mill and the rolling method described in Patent Document 5, a work roll chock is pressed against a contact surface with a housing window or a project block of the rolling mill in a rolling direction. Then, a load detection device measures rolling direction forces acting on roll chocks on an operator side and a driving side of a work roll, and a calculation device a calculation device calculates a difference of the rolling direction forces between the operator side and the driving side. A control device calculates left-right swivelling component control quantity of a roll gap of the rolling mill such that the difference become a control target value, and controls the roll gap on the basis of the calculated value of the left-right swivelling component control quantity of the roll gap.

Here, in any of the rolling methods and the rolling apparatuses described in the above Patent Documents 1 to 5, the rolling direction forces are measured. Accordingly, with reference to FIG. 1, the measurement of the rolling direction forces according to Patent Documents 1 to 5 will be described specifically. FIG. 1 is a view schematically showing a rolling apparatus.

The rolling apparatus shown in FIG. 1 includes an upper work roll 1 supported by an upper work roll chock 5, an upper backup roll 3 supported by an upper backup roll chock 7, a lower work roll 2 supported by a lower work roll chock 6, and a lower backup roll 4 supported by a lower backup roll chock 8. The upper backup roll 3 is disposed on the upper side of the upper work roll 1 in contact with the upper work roll 1. In the same manner, the lower backup roll 4 is disposed on the lower side of the lower work roll 2 in contact with the lower work roll 2. Further, the rolling apparatus shown in FIG. 1 includes a screw down device 9 that applies a rolling load to the upper work roll 1. A flat-rolled metal material M to be rolled by the rolling apparatus moves in a rolling direction F between the upper work roll 1 and the lower work roll 2.

Though FIG. 1 basically shows only the apparatus construction on the operator side, similar devices exist on the driving side, too.

The rolling direction force acting on the upper work roll 1 of the rolling apparatus is basically supported by the upper work roll chock 5. Between the upper work roll chock 5 and a housing or a project block, there are provided an upper work roll chock exit side load detection device 121 on an exit side of the upper work roll chock 5 in the rolling direction, and an upper work roll chock entry side load detection device 122 on an entry side of the upper work roll chock 5 in the rolling direction. The upper work roll chock exit side load detection device 121 can detect the force acting between the member such as the housing or the project block and the upper work roll chock 5 on the exit side of the upper work roll chock 5 in the rolling direction. The upper work roll chock entry side load detection device 122 can detect the force acting between the member such as the project block and the upper work roll chock 5 on the entry side of the upper work roll chock 5 in the rolling direction. To simplify the device construction, those load detection devices 121 and 122 preferably and ordinarily have a construction for measuring a compressive force.

The upper work roll chock exit side load detection device 121 and the upper work roll chock entry side load detection device 122 are connected to an upper work roll rolling direction force calculation device 141. The upper work roll rolling direction force calculation device 141 calculates a difference between a load detected by the upper work roll chock exit side load detection device 121 and a load detected by the upper work roll chock entry side load detection device 122, and, on the basis of the calculation result, calculates the rolling direction force acting on the upper work roll chock 5.

In the same manner, as for the lower work roll 2, between the lower work roll chock 6 and the housing or the project block, there are provided an lower work roll chock exit side load detection device 123 on an exit side of the lower work roll chock 6 in the rolling direction, and a lower work roll chock entry side load detection device 124 on an entry side of the lower work roll chock 6 in the rolling direction. The lower work roll chock exit side load detection device 123 and the lower work roll chock entry side load detection device 124 are connected to a lower work roll rolling direction force calculation device 142. The lower work roll rolling direction force calculation device 142 calculates, on the basis of measurement values obtained by those load detection devices 123 and 124, the rolling direction force acting on the lower work roll chock 6 in the same manner as in the upper work roll 1.

PRIOR ART DOCUMENT(S)

Patent Document(s)

[Patent Document 1] WO2004/082860
[Patent Document 2] JP2007-260775 A
[Patent Document 3] WO2011/129453
[Patent Document 4] JP2006-82118 A
[Patent Document 5] JP2012-148339 A

SUMMARY OF THE INVENTION

Problem(s) to be Solved by the Invention

Here, taking into consideration the drawings on the figures in Patent Documents 1 to 5 and technical common knowledge in the field of rolling, a load detection device is normally a load cell. It is difficult to attach the load cell on a work roll chock due to size constraint. Accordingly, the load cell is generally attached to a member that faces the work roll chock in a rolling direction, such as a project block or a housing.

FIG. 2 is an enlarged side view of the work roll chocks of the rolling apparatus shown in FIG. 1 and a periphery thereof, and shows an example in which load detection devices are attached to project blocks. In the example shown in FIG. 2, a housing 10 is provided with an exit side project block 11 and an entry side project block 12. The exit side project block 11 and the entry side project block 12 are formed so as to protrude from the housing 10 towards the inner side of the rolling apparatus.

In the example shown in FIG. 2, the upper work roll chock exit side load detection device 121 and the lower work roll chock exit side load detection device 123 are provided on the exit side project block 11. On the other hand, the upper work roll chock entry side load detection device 122 and the lower work roll chock entry side load detection device 124 are provided on the entry side project block 12. Note that, although a protection cover or waterproofing for preventing water or the like entering inside the device is generally provided on the surface of the load detection device, they are not shown in the figure.

FIG. 2 also shows an example of a kiss-roll tightening state. As shown in FIG. 2, each of the load detection devices 121, 122, 123, and 124 has a small size in an opening/closing direction, that is, a draft direction (also referred to as height direction) of the rolls. Accordingly, the distances that the load detection devices 121 and 122 are in contact with side surfaces of the work roll chock 5 and the distances that the load detection devices 123 and 124 are in contact with side surfaces of the work roll chock 6 are small.

Here, in the example shown in FIG. 2, the positions (heights) of the respective load detection devices 121 and 122 in the draft direction are the same as the position (height) of a roll axis A1 of the work roll 1 held by the work roll chock 5 in the draft direction, and the positions (heights) of the respective load detection devices 123 and 124 in the draft direction are the same as the position (height) of a roll axis A2 of the work roll 2 held by the work roll chock 6 in the draft direction. In this case, rolling direction forces applied to the work roll chocks 5 and 6 is appropriately detected by the load detection devices 121, 122, 123, and 124.

However, as shown in FIG. 3, for example, when the upper work roll 1 rises and a gap between the work rolls 1 and 2 increases, the height of the position of the roll axis A1 of the upper work roll 1 in the draft direction is larger than the heights of the positions of the upper work roll chock exit side load detection device 121 and the upper work roll chock entry side load detection device 122 in the draft direction. Accordingly, the moment acts on the upper work roll chock 5, and thus, the upper work roll chock 5 rotates in a direction indicated by an arrow shown in FIG. 3. As a result, the upper work roll chock 5 tilts, and parts on the side surfaces of the upper work roll chock 5 come into contact with the project blocks 11, 12, and the like.

In this way, when parts on the side surfaces of the upper work roll chock 5 come into contact with the project blocks 11, 12, and the like, some of the rolling direction force applied to the upper work roll chock 5 from the upper work roll 1 is applied to the parts at which the upper work roll chock 5 comes into contact with the project blocks 11 and 12. Accordingly, it may not be possible for the load detection devices 121 and 122 to accurately detect the rolling direction force.

Further, for example, as shown in FIG. 4, when the work rolls 1 and 2 and the backup rolls 3 and 4 are worn away, and thus decrease in the roll diameters, the upper work roll chock 5 and the lower work roll chock 6 move downward in the draft direction. When the upper work roll chock 5 and the lower work roll chock 6 move downward, the height of the position of the axis A1 of the work roll 1 in the draft direction is smaller than the heights of the positions of the work roll chock exit side load detection device 121 and the work roll chock entry side load detection device 122, and the height of the position of the axis A2 of the work roll 2 in the draft direction is smaller than the heights of the positions of the work roll chock exit side load detection device 123 and the work roll chock entry side load detection device 124. Also in this case, in the same manner as the case shown in FIG. 3, the work roll chocks 5 and 6 tilt, and parts on the side surfaces of the work roll chocks 5 and 6 come into contact with the project blocks 11 and 12. As a result, it may not possible for the load detection devices 121, 122, 123, and 124 to accurately detect the rolling direction force.

Further, FIG. 5 is a cross-sectional plan view taken along the line V-V of FIG. 2, showing the work roll chocks and a periphery thereof. As can be seen from FIG. 5, the load detection devices 121 and 122 have sizes whose widths in the roll axis direction are small. Accordingly, the load detection devices 121 and 122 come into contact only with parts on the side surfaces of the work roll chocks 5 and 6 also in the roll axis direction.

That is, for example, as shown in FIG. 5, when the lower work roll 2 moves owing to roll shifting for a shift quantity D in the roll axis direction, it means that the center of a bearing (hereinafter, also referred to as "radial bearing") 5*a* to which force in a radial direction of the upper work roll chock 5 is applied shifts in the roll axis direction with respect to the positions of the load detection devices 121 and 122. Note that, in FIG. 5, a line C shows a line the center of the radial bearing 5*a* of the upper work roll chock 5. Accordingly, the moment acts on the upper work roll chock 5, and thus, the upper work roll chock 5 rotates in a direction indicated by an arrow shown in FIG. 5. As a result, the upper work roll chock 5 tilts, and parts on the side surfaces of the upper work roll chock 5 come into contact with the project blocks 11 and 12.

In this way, when parts on the side surfaces of the upper work roll chock 5 come into contact with the project blocks 11, 12, and the like, some of the rolling direction force applied to the upper work roll chock 5 from the upper work roll 1 is applied to the parts at which the upper work roll chock 5 comes into contact with the project blocks 11 and 12. Accordingly, it may not be possible for the load detection devices 121 and 122 to accurately detect the rolling direction force.

The present invention has been made in view of the circumstances described above, and an object of the present invention is to provide a rolling apparatus capable of accurately detecting a rolling direction force applied to a work roll chock.

Means for Solving the Problem(s)

The inventors of the present invention have conducted studies on rolling apparatuses having various structures, with regard to detection of the rolling direction force applied to the work roll chock.

As a result, the inventors have found that the rotation of the work roll chock can be suppressed by providing multiple load detection devices on a housing on an entry side or an exit side of the work roll chock in the rolling direction and disposing the multiple load detection devices in a manner that the multiple load detection devices are shifted in the rolling direction or in the roll axis direction, and as a result, that the rolling direction force applied to the work roll chock can be accurately detected. Note that a load detection device according to the present invention mainly represents a load cell, and may also be a device of a strain gauge, a magnetostriction type, a capacitance type, a gyro type, a hydraulic type, a piezoelectric type, or the like.

The present invention has been achieved on the basis of the above findings, and the summary is as follows.

(1)

A rolling apparatus for a flat-rolled metal material, the rolling apparatus including at least a pair of upper and lower work rolls, and a pair of upper and lower backup rolls supporting the respective work rolls, the rolling apparatus including:

a pair of work roll chocks configured to hold the respective work rolls;

housings or project blocks configured to hold the work roll chocks; and one or more rolling direction force measurement devices configured to measure rolling direction forces acting on the work roll chocks, wherein at least one of the rolling direction force measurement devices includes a plurality of load detection devices on an entry side or an exit side of the work roll chocks in a rolling direction, and the plurality of load detection devices are provided to one of the housings or one of the project blocks, and wherein the load detection devices are disposed in a manner that, on all occasions, a line extending in the rolling direction and including a point of effort of a rolling direction force of one of the work rolls is interposed between at least two of the load detection devices in a draft direction, and the at least two of the load detection devices face a side surface of a corresponding one of the work roll chocks.

(2)

The rolling apparatus according to (1), wherein, in at least one of the rolling direction force measurement devices, the load detection devices are disposed in a manner that, on all occasions, a line extending in the rolling direction and including a point of effort of a rolling direction force of one of the work rolls is interposed between at least two of the load detection devices in a roll axis direction of the work rolls, and the at least two of the load detection devices face a side surface of a corresponding one of the work roll chocks.

(3)

The rolling apparatus according to (1) or (2), wherein at least one of the rolling direction force measurement devices includes at least three load detection devices on the entry side or the exit side of the work roll chocks in a rolling direction, and the at least three load detection devices are provided to one of the housings or one of the project blocks, and wherein the load detection devices are disposed so as to be shifted in one of the draft direction and the roll axis direction of the work rolls, in a manner that the point of effort of the rolling direction force of each of the work rolls is located within an area defined by connecting the load detection devices.

(4)

The rolling apparatus according to any one of (1) to (3), further including:

a rolling direction force calculation device configured to calculate a rolling direction force by adding up loads of the one or more rolling direction force measurement devices each including the plurality of load detection devices, the loads being detected by the respective load detection devices.

(5)

The rolling apparatus according to any one of (1) to (4), wherein the rolling apparatus is provided with the rolling direction force measurement devices on an exit side of an upper work roll chock, an entry side of the upper work roll chock, an exit side of the lower work roll chock, and an entry side of the lower work roll chock, respectively.

(6)

The rolling apparatus according to (5), wherein, out of the rolling direction force measurement devices, the plurality of load detection devices are provided only to the one or more rolling direction force measurement devices configured to measure any one of a rolling direction force acting in a rolling direction toward the exit side and a rolling direction force acting in a rolling direction toward the entry side.

(7)

The rolling apparatus according to (5), wherein all of the rolling direction force measurement devices each have the plurality of load detection devices.

(8)

The rolling apparatus according to (5), wherein, out of the rolling direction force measurement devices, the plurality of load detection devices are provided only to the one or more rolling direction force measurement devices for any one of the upper work roll chock and the lower work roll chock.

(9)

The rolling apparatus according to (7) or (8), wherein the plurality of load detection devices are disposed in a manner that positions in a draft direction and positions in a roll axis direction of the plurality of load detection devices provided on the entry side in the rolling direction are identical to positions in a draft direction and positions in a roll axis direction of the plurality of load detection devices provided on the exit side in the rolling direction.

(10)

The rolling apparatus according to any one of (7) to (9), wherein the rolling direction force calculation device calculates a rolling direction force on the basis of an entry side load calculated by adding up loads detected by the plurality of load detection devices provided on the entry side in the rolling direction and an exit side load calculated by adding up loads detected by the plurality of load detection devices provided on the exit side in the rolling direction.

(11)

The rolling apparatus according to any one of (1) to (10), wherein the load detection devices are each a load cell.

(12)

The rolling apparatus according to any one of (1) to (11), further including:

a cover configured to cover each of the load detection devices, the cover being provided between one of the housings or one of the project blocks and each of the load detection devices (13)

The rolling apparatus according to any one of (1) to (11), further including:

a cover configured to collectively cover the load detection devices for each of the rolling direction force measurement devices, the cover being provided between one of the housings or one of the project blocks and each of the load detection devices.

Effect(s) of the Invention

According to the present invention, there is provided a rolling apparatus capable of accurately detecting a rolling direction force applied to a work roll chock.

BRIEF DESCRIPTION OF THE DRAWING(S)

Figure 4:
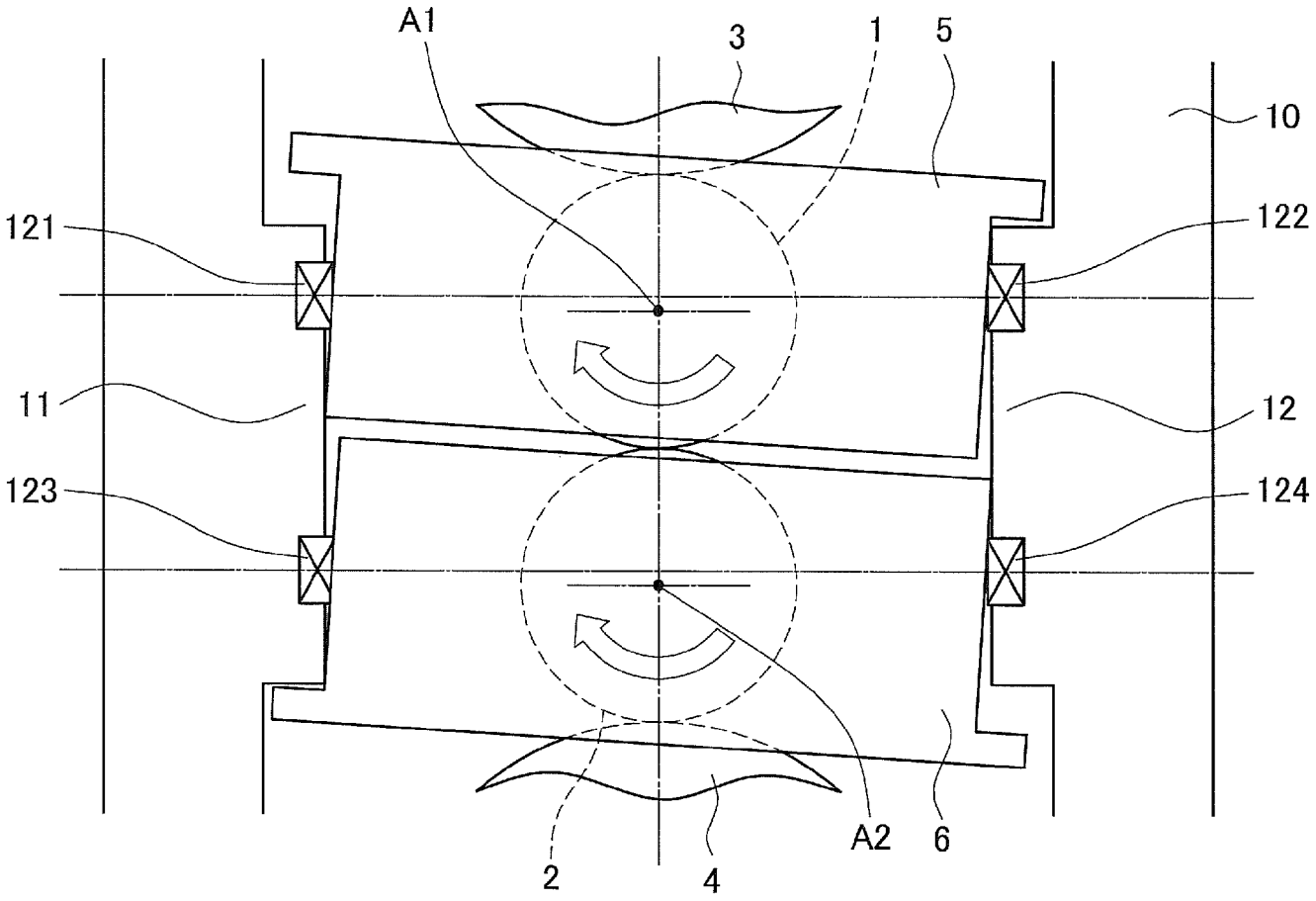

FIG. 4 is a side view illustrating a problem to be solved in measuring rolling direction forces by rolling load detection devices of prior art, and shows a state in which a roll axis of an upper work roll and a roll axis of a lower work roll shift with respect to positions of the rolling load detection devices in a draft direction and in which an upper work roll chock and a lower work roll chock tilt.

Figure 5:
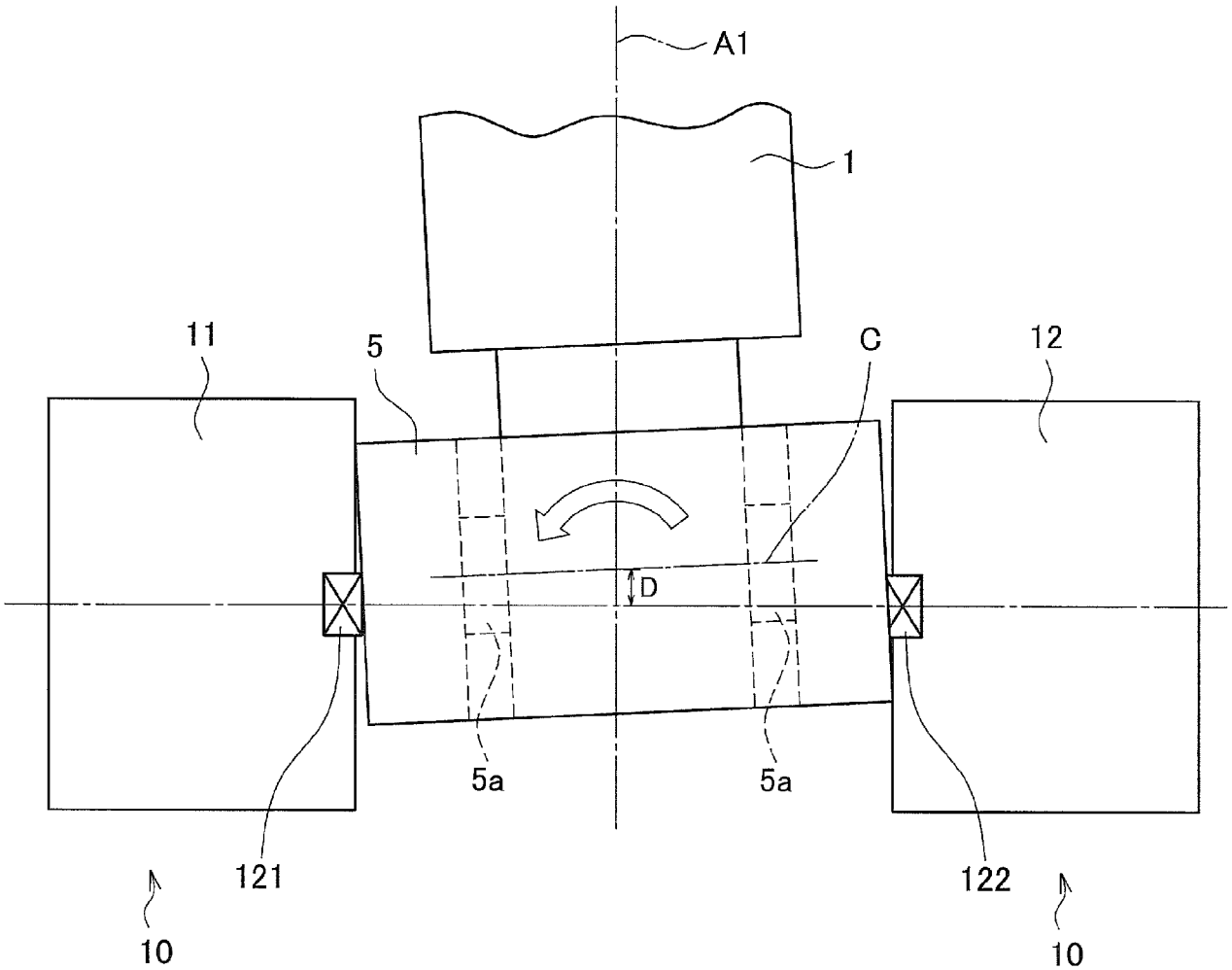

FIG. 5 is a cross-sectional plan view illustrating a problem to be solved in measuring a rolling direction force by rolling load detection devices of prior art, and shows a state in which a center of a radial bearing shifts with respect to positions of the rolling load detection devices in a roll axis direction and in which a work roll chock tilts.

Figure 6:
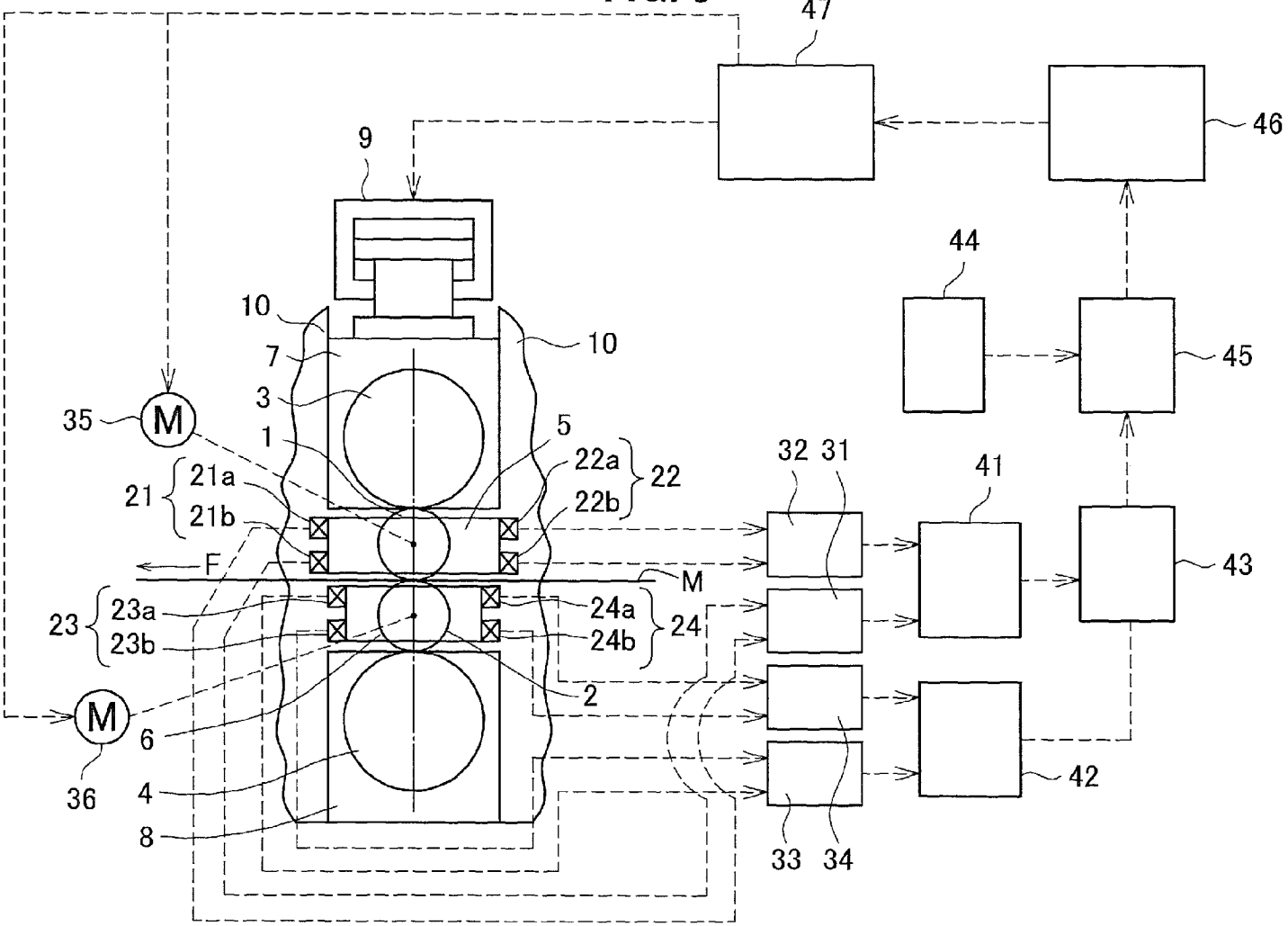

FIG. 6 is a view schematically showing a rolling apparatus according to a first construction example of the present invention.

Figure 7:
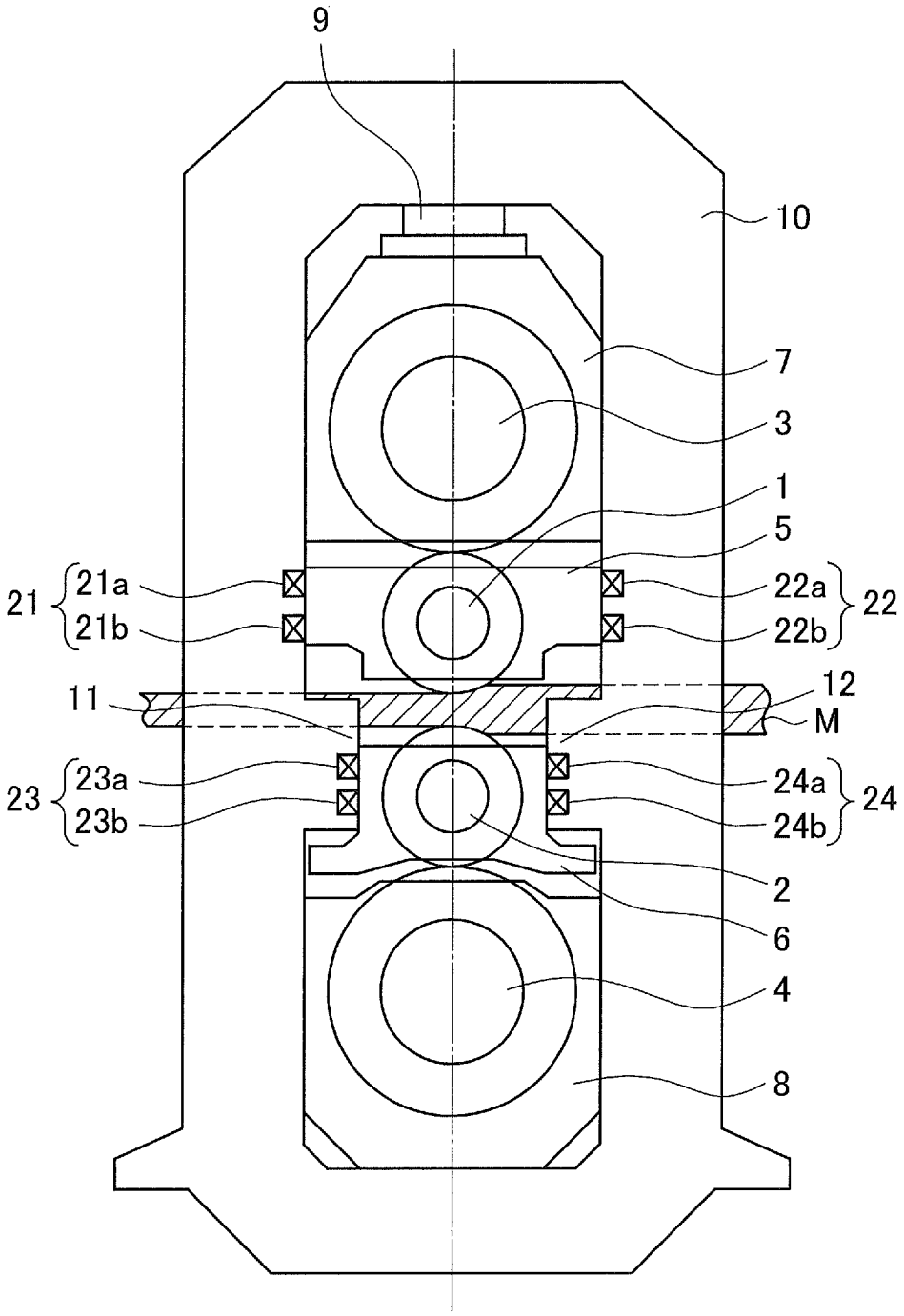

FIG. 7 is a side view schematically showing a main body of the rolling apparatus according to the first construction example.

Figure 8:
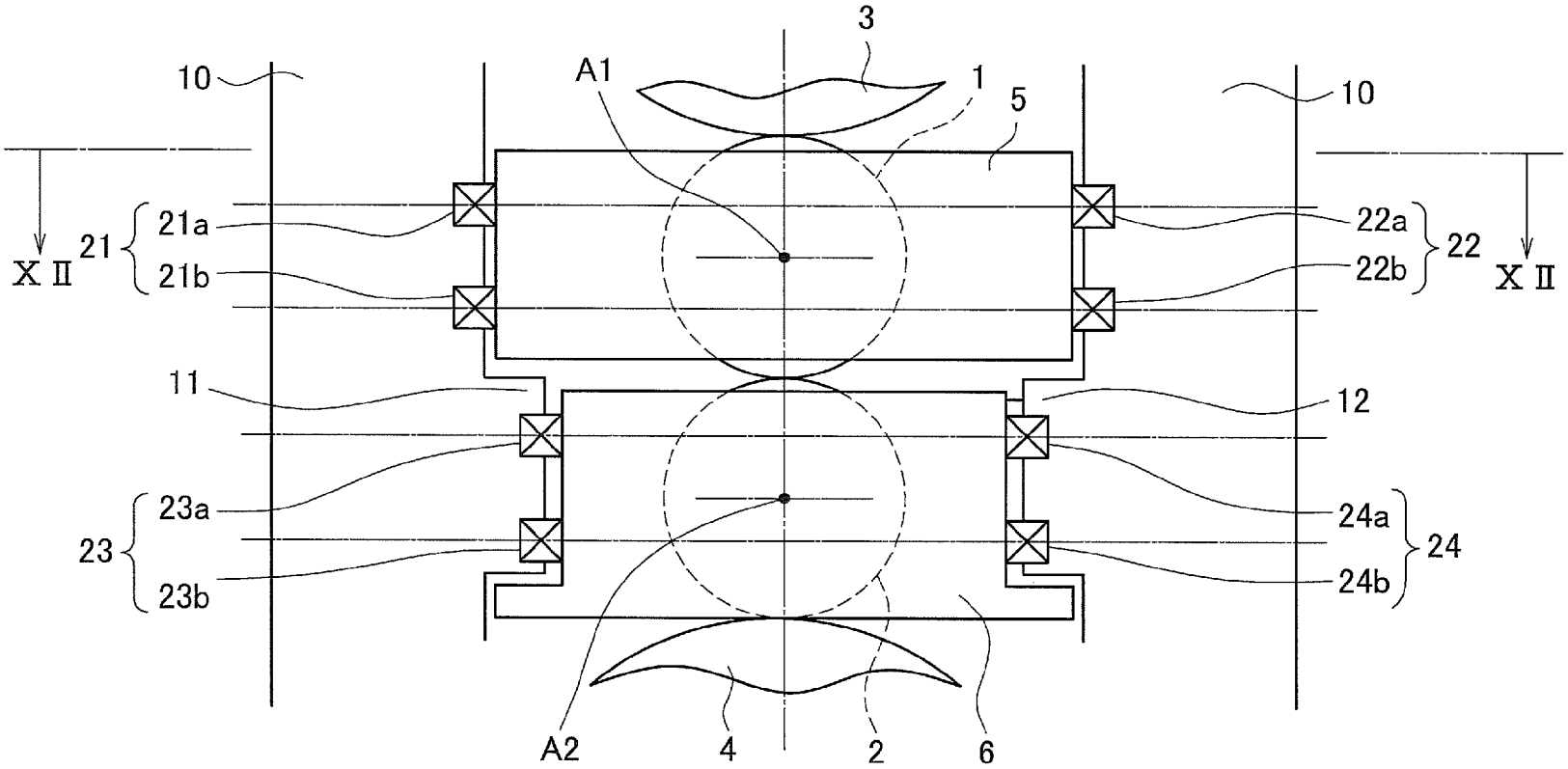

FIG. 8 is an enlarged side view of an upper work roll chock of the rolling apparatus shown in FIG. 6 and FIG. 7 and a periphery thereof.

Figure 9:
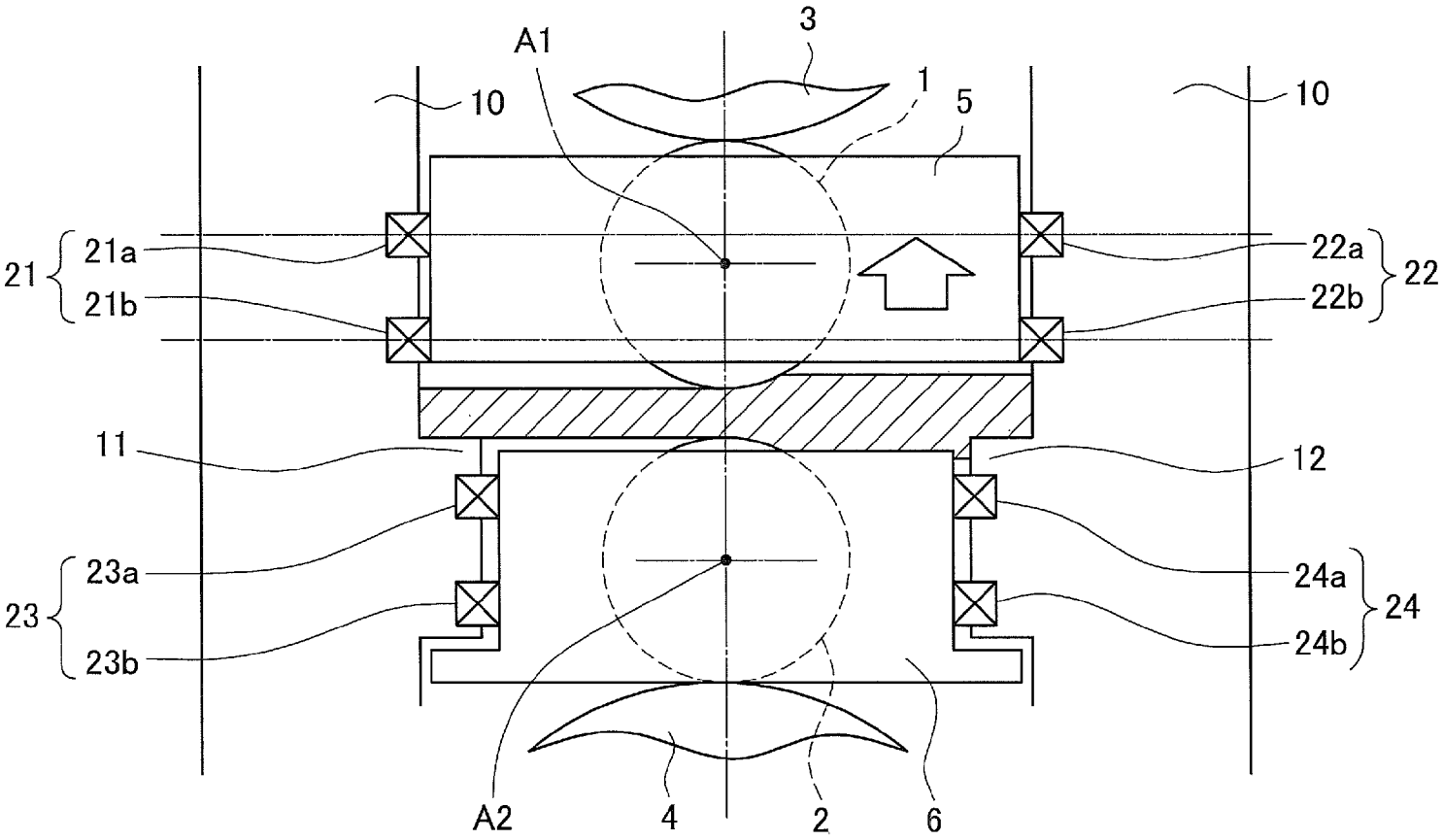

FIG. 9 is a side view illustrating functions and effects in measuring a rolling direction force by a rolling apparatus according to the present invention, and shows a state in which an upper work roll rises in a draft direction.

Figure 10:
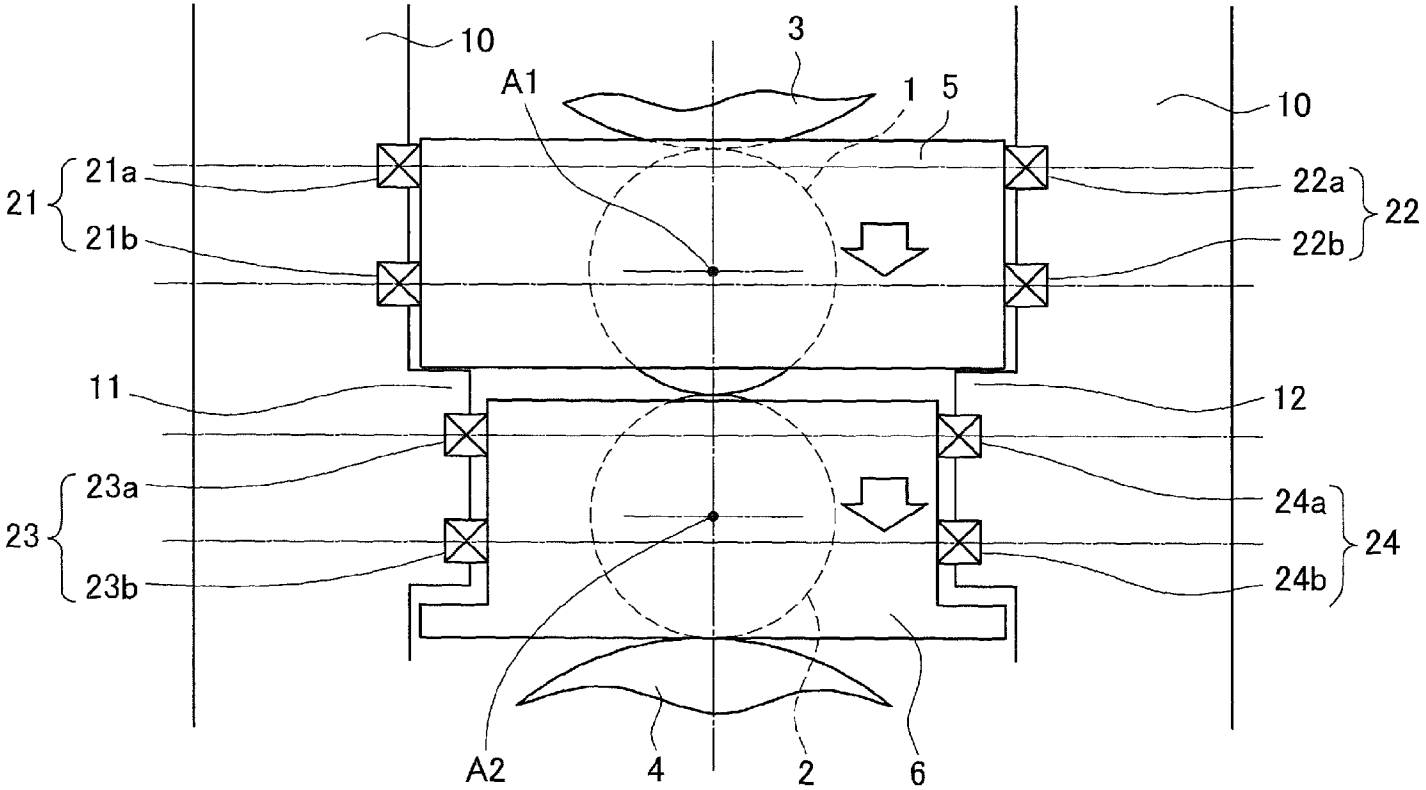

FIG. 10 is a side view illustrating functions and effects in measuring a rolling direction force by a rolling apparatus according to the present invention, and shows a state in which an upper work roll and a lower work roll move downward in a draft direction.

Figure 11:
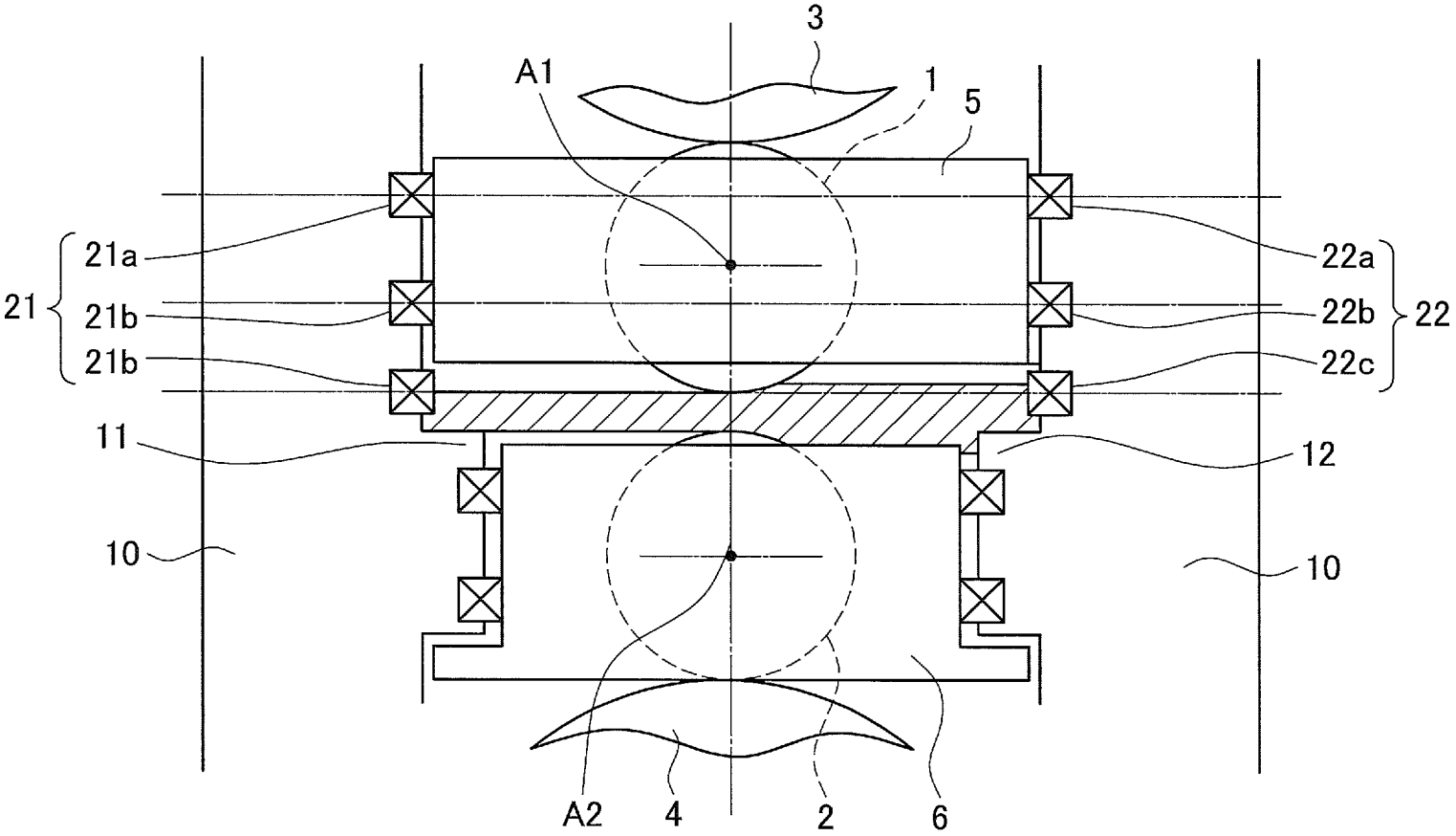

FIG. 11 is a side view showing a modified example of the first construction example.

Figure 12:
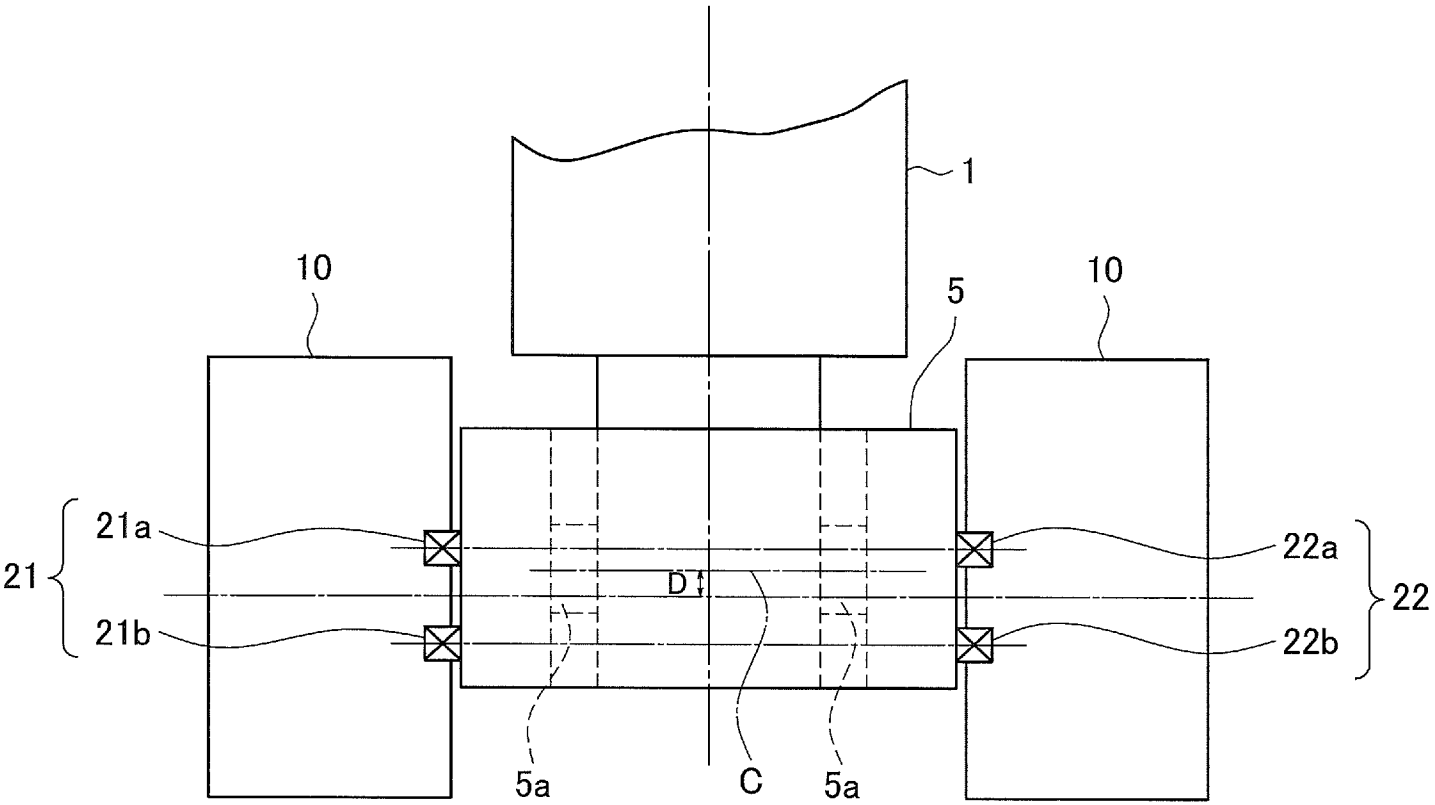

FIG. 12 is an enlarged cross-sectional plan view of a work roll chock and a periphery thereof taken along the line XII-XII of FIG. 8, which shows a second construction example of a rolling apparatus according to an embodiment of the present invention.

Figure 13:
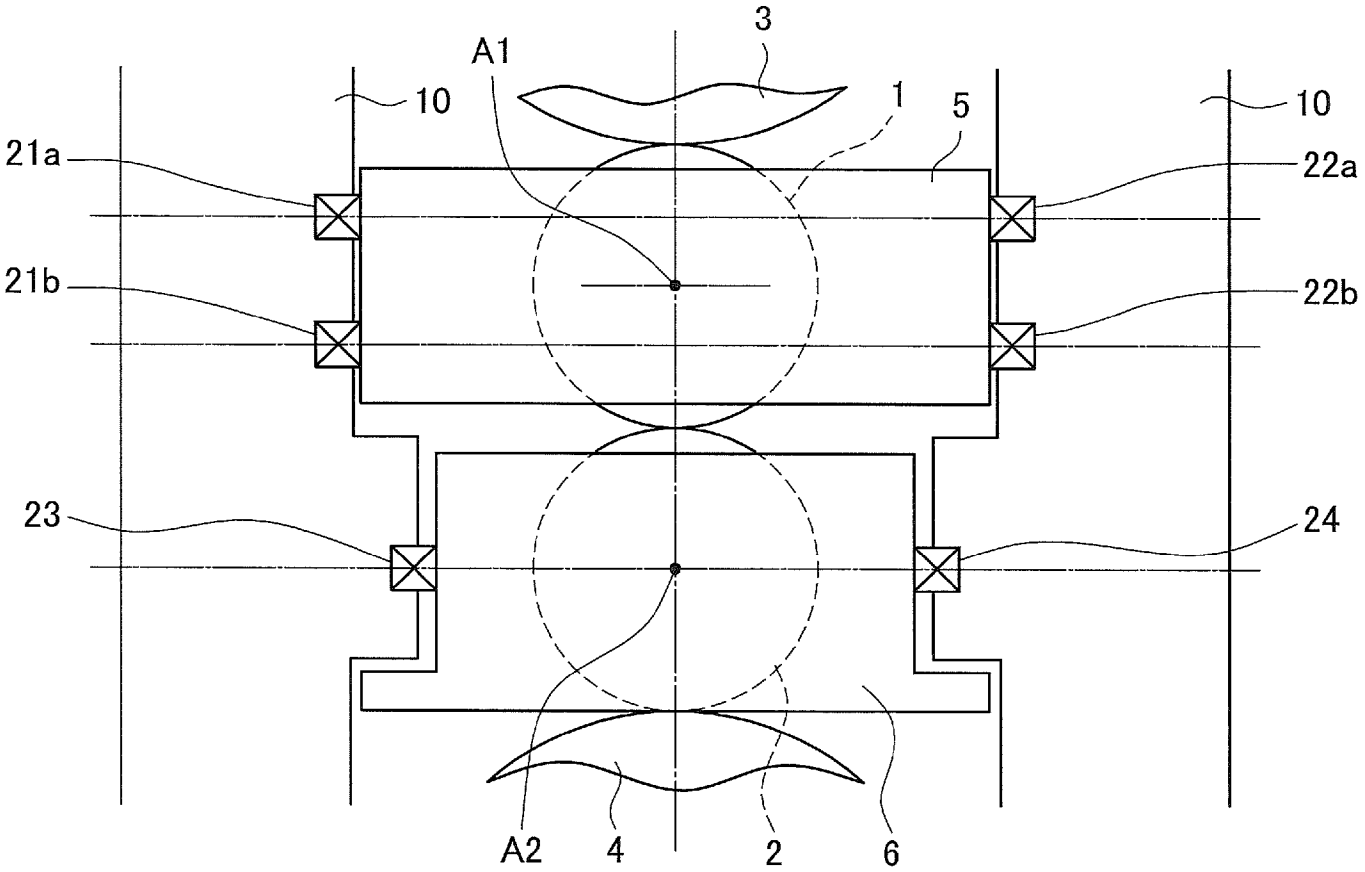

FIG. 13 is a side view showing a third construction example of a rolling apparatus according to an embodiment of the present invention.

Figure 14:
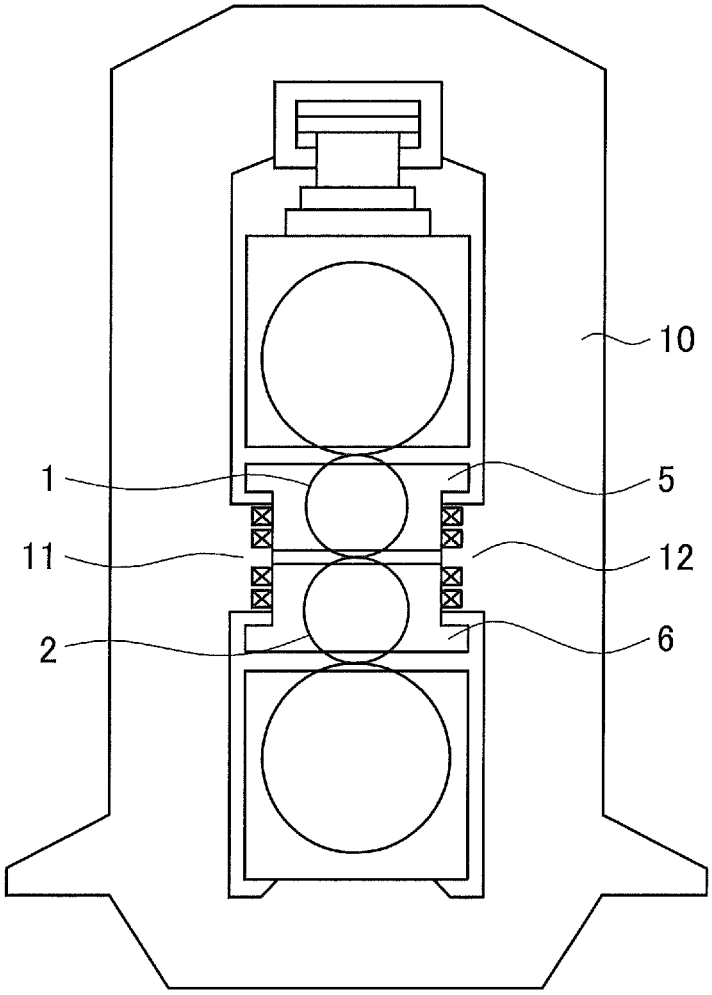

FIG. 14 is a side view showing a fifth construction example of a rolling apparatus according to an embodiment of the present invention.

Figure 15:
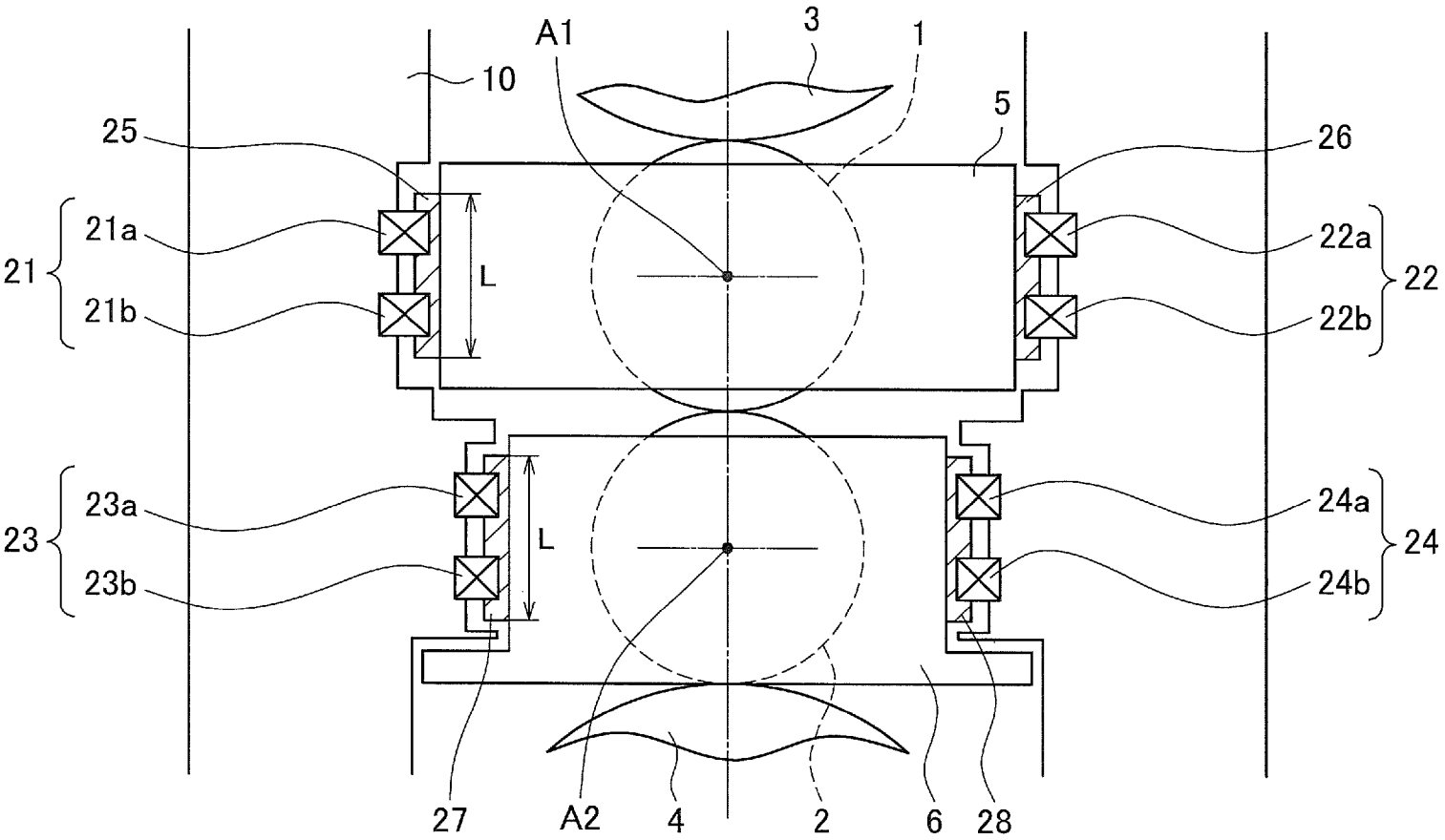

FIG. 15 is a side view showing a sixth construction example of a rolling apparatus according to an embodiment of the present invention.

Figure 16:
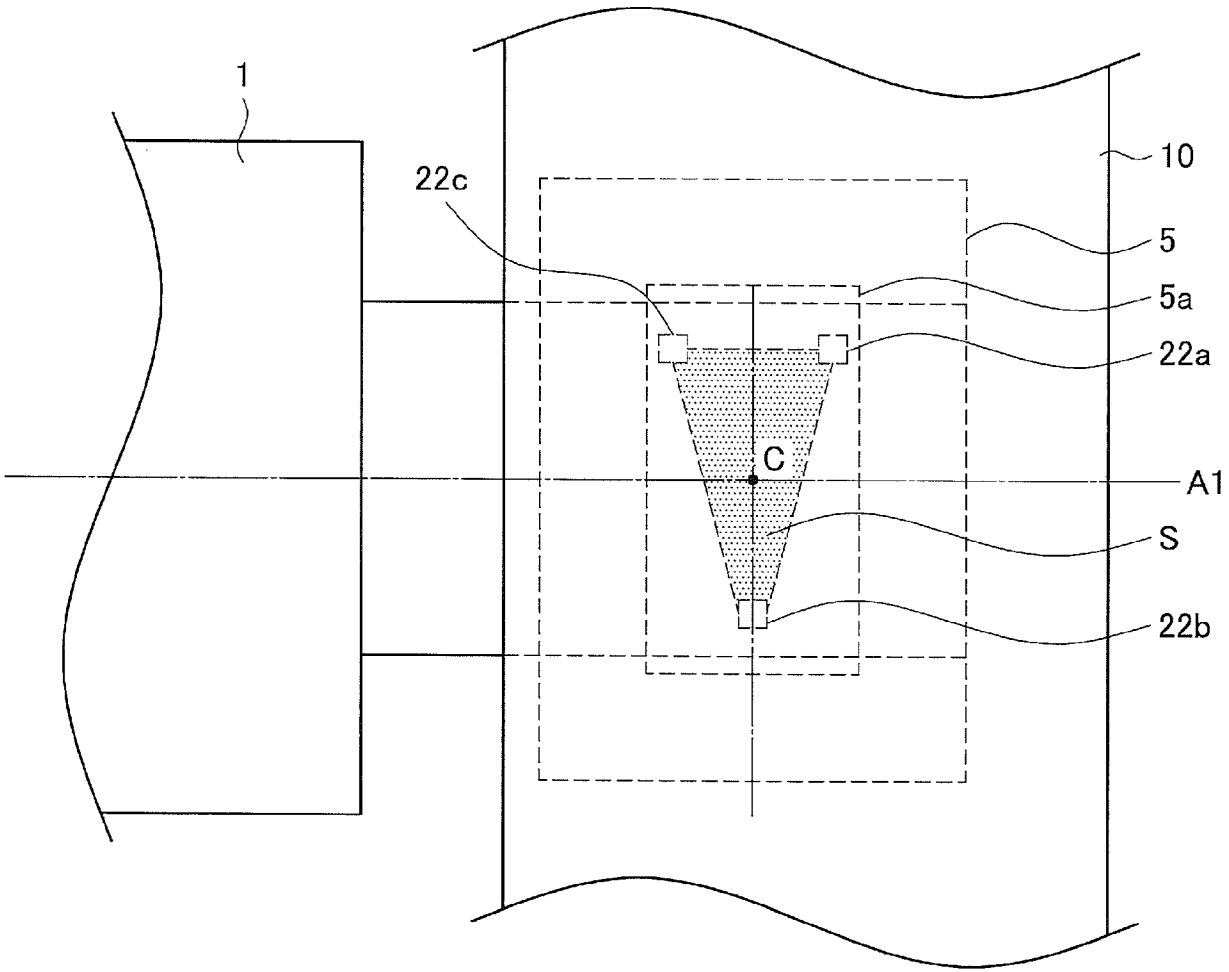

FIG. 16 is an elevational view showing an arrangement example in a case where a rolling direction force measurement device of a rolling apparatus according to an embodiment of the present invention has three load detection devices.

Figure 17:
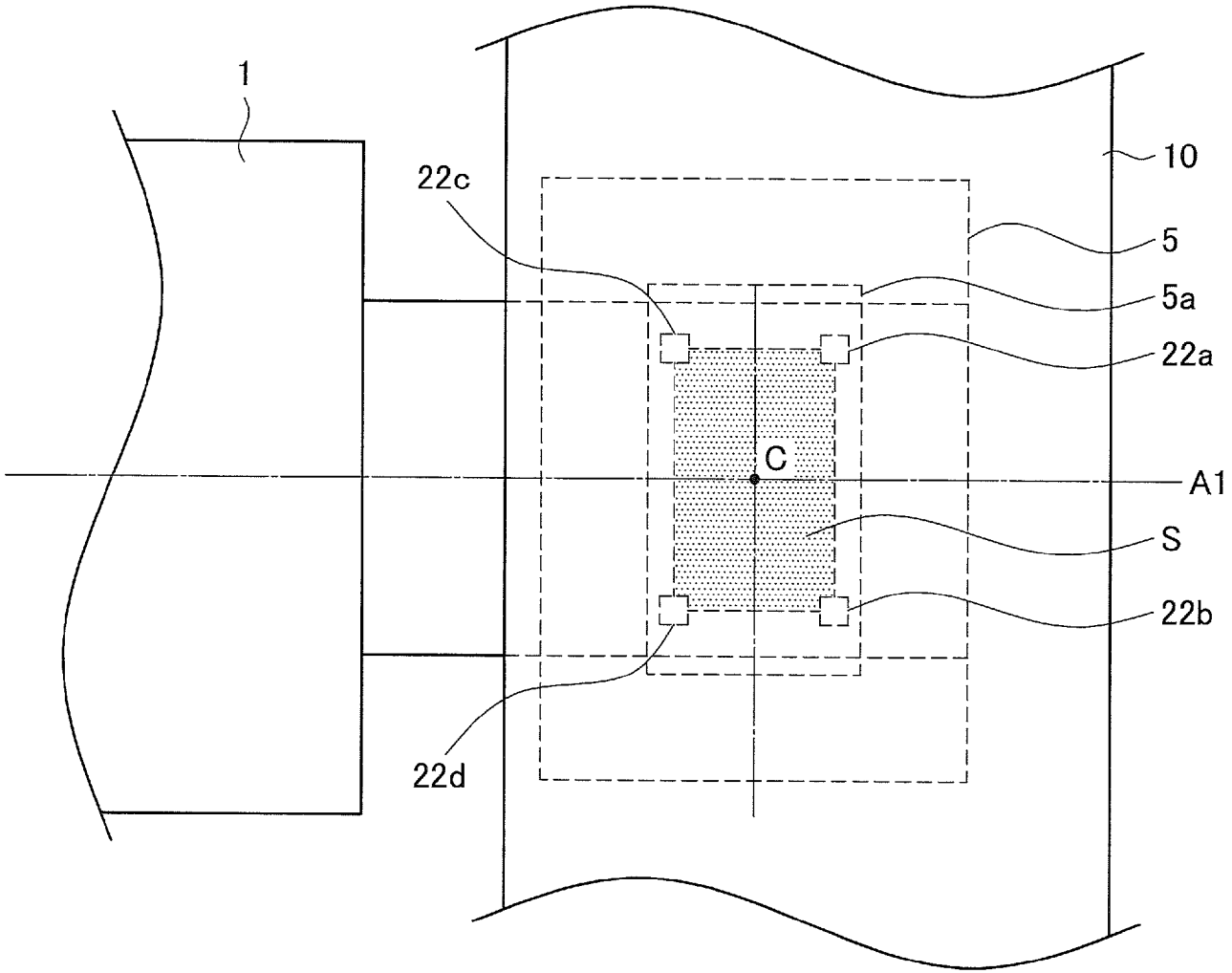

FIG. 17 is an elevational view showing an arrangement example in a case where a rolling direction force measurement device of a rolling apparatus according to an embodiment of the present invention has four load detection devices.

MODE(S) FOR CARRYING OUT THE INVENTION

Hereinafter, referring to the appended drawings, preferred embodiments of the present invention will be described in detail. It should be noted that, in the above description with reference to FIGS. 1 to 5 and the following description, structural elements that have substantially the same function and structure are denoted with the same reference numerals.

1. Configuration of Rolling Apparatus and Functions and Effects of Rolling Apparatus

1-1. First Construction Example

FIG. 6 is a view schematically showing a rolling apparatus according to a first construction example of the present invention. FIG. 7 is a side view schematically showing a main body of the rolling apparatus. In the same manner as the rolling apparatus shown in FIG. 1, the rolling apparatus shown in FIG. 6 and FIG. 7 includes an upper work roll 1 supported by an upper work roll chock 5, an upper backup roll 3 supported by an upper backup roll chock 7, a lower work roll 2 supported by a lower work roll chock 6, and a lower backup roll 4 supported by a lower backup roll chock 8. Further, the rolling apparatus shown in FIG. 6 and FIG. 7 includes a screw down device 9 that controls a gap between the upper and lower work rolls, and an upper drive electric motor 35 and a lower drive electric motor 36 that drive the upper and lower work rolls, respectively. A flat-rolled metal material M to be rolled by the rolling apparatus moves in a rolling direction F. Though FIG. 6 and FIG. 7 basically show only the apparatus construction on the operator side, similar devices exist on the driving side, too.

As shown in FIG. 7, in the present embodiment, a housing 10 is provided with an exit side project block 11 and an entry side project block 12. The exit side project block 11 and the entry side project block 12 are formed so as to protrude from the housing 10 towards the inner side.

Further, in the same manner as the rolling apparatuses shown in FIGS. 1 to 5, the rolling apparatus shown in FIG. 6 and FIG. 7 includes rolling direction force measurement devices measuring rolling direction forces acting on the work roll chocks 5 and 6 at the time of rolling a flat-rolled metal material. However, the construction of the rolling direction force measurement devices included in the rolling apparatus shown in FIG. 6 and FIG. 7 is different from the construction of the rolling direction force measurement devices formed of the load detection devices 121, 122, 123, and 124 shown in FIGS. 1 to 5.

As shown in FIG. 6 and FIG. 7, the rolling apparatus of the present construction example is provided with four rolling direction force measurement devices 21, 22, 23, and 24 on the operator side. Note that the measurement devices are also provided to the driving side, the number of the measurement devices being the same as the number of the measurement devices on the operator side.

An upper work roll chock exit side rolling direction force measurement device 21 is provided on an exit side of the upper work roll chock 5 in the rolling direction on an exit side of the housing 10 in the rolling direction. The rolling direction force measurement device 21 detects a force acting between the housing 10 and the upper work roll chock 5 on the exit side, that is, the rolling direction force measurement device 21 detects a rolling direction force acting on the upper work roll chock 5 in the rolling direction toward the exit side. An upper work roll chock entry side rolling direction force measurement device 22 is provided on an entry side of the upper work roll chock 5 in the rolling direction on an entry side of the housing 10 in the rolling direction. The rolling direction force measurement device 22 detects a force acting between the housing 10 and the upper work roll chock 5 on the entry side, that is, the rolling direction force measurement device 22 detects a rolling direction force acting on the upper work roll chock 5 in the rolling direction toward the entry side.

In the same manner, a lower work roll chock exit side rolling direction force measurement device 23 is provided on an exit side of the lower work roll chock 6 in the rolling direction on the exit side project block 11. The rolling direction force measurement device 23 detects a force acting between the exit side project block 11 and the lower work roll chock 6, that is, the rolling direction force measurement device 23 detects a rolling direction force acting on the lower work roll chock 6 in the rolling direction toward the exit side. A lower work roll chock entry side rolling direction force measurement device 24 is provided on an entry side of the lower work roll chock 6 in the rolling direction on the entry side project block 12. The rolling direction force measurement device 24 detects a force acting between the entry side project block 12 and the lower work roll chock 6, that is, the rolling direction force measurement device 24 detects a rolling direction force acting on the lower work roll chock 6 in the rolling direction toward the entry side.

As shown in FIG. 6 and FIG. 7, in the present embodiment, each of the rolling direction force measurement devices 21, 22, 23, and 24 includes multiple load detection devices. For example, the upper work roll chock exit side rolling direction force measurement device 21 includes a first load detection device 21*a* and a second load detection device 21*b*.

FIG. 8 is an enlarged schematic side view of an upper work roll chock 5 of the rolling apparatus shown in FIG. 6 and FIG. 7 and the periphery thereof. The load detection devices 21*a* and 21*b* are both disposed on the housing 10 on the exit side. Further, as shown in FIG. 8, the load detection devices 21*a* and 21*b* are disposed in a manner that a line extending in the rolling direction and including a roll axis A1, which is a point of effort of the rolling direction force of the upper work roll 1 in the draft direction of the upper work roll 1, is interposed between the load detection devices 21*a* and 21*b*.

In particular, in the present embodiment, during the rolling of the flat-rolled metal material M, the two load detection devices 21*a* and 21*b* are always disposed in a manner that the load detection devices 21*a* and 21*b* face a side surface of the upper work roll chock 5 even if the position of the upper work roll chock 5 changes in the draft direction within a movable range of the upper work roll chock 5. It is preferred in the present embodiment, even if the position of the upper work roll chock 5 changes in the draft direction within the movable range of the upper work roll chock 5, that one of the load detection devices, that is, the load detection device 21*a*, be always placed above the roll axis of the upper work roll 1 in the draft direction, and that the other load detection device, that is, the load detection device 21*b*, be always placed below the roll axis of the upper work roll 1 in the draft direction.

The thus constructed two load detection devices 21*a* and 21*b* of the rolling direction force measurement device 21 are connected to an upper work roll chock exit side load calculation device 31 as shown in FIG. 6. The load calculation device 31 adds up a load detected by the first load detection device 21*a* and a load detected by the second load detection device 21*b*. The total value of those detected loads corresponds to a rolling direction force applied to the housing 10 on the exit side from the upper work roll chock 5, that is, a rolling direction force of the upper work roll chock 5 toward the exit side.

In the same manner, the upper work roll chock entry side rolling direction force measurement device 22 includes a first load detection device 22*a* and a second load detection device 22*b*. The load detection devices 22*a* and 22*b* are both disposed on the housing 10 on the entry side. Further, as shown in FIG. 8, the load detection devices 22*a* and 22*b* are disposed in a manner that a line extending in the rolling direction and including the roll axis A1, which is a point of effort of the rolling direction force of the upper work roll 1 in the draft direction of the upper work roll 1, is interposed between the load detection devices 22*a* and 22*b*. In particular, in the present embodiment, the first load detection device 22*a* is disposed such that the position of the first load detection device 22*a* on the entry side of the upper work roll chock in the draft direction is the same as the position of the first load detection device 21*a* on the exit side of the upper work roll chock in the draft direction. In the same manner, the second load detection device 22*b* is disposed such that the position of the second load detection device 22*b* on the entry side of the upper work roll chock in the draft direction is the same as the position of the second load detection device 21*b* on the exit side of the upper work roll chock in the draft direction.

The thus constructed two load detection devices 22*a* and 22*b* of the rolling direction force measurement device 22 are connected to an upper work roll chock entry side load calculation device 32 as shown in FIG. 6. The load calculation device 32 adds up loads detected by the load detection devices 22*a* and 22*b*. In this way, a rolling direction force applied to the housing 10 on the entry side from the upper work roll chock 5, that is, a rolling direction force of the upper work roll chock 5 toward the entry side is calculated.

In the same manner, the lower work roll chock exit side rolling direction force measurement device 23 includes a first load detection device 23*a* and a second load detection device 23*b*. The load detection devices 23*a* and 23*b* are both disposed on the exit side project block 11. Further, as shown in FIG. 8, the load detection devices 23*a* and 23*b* are disposed in a manner that a line extending in the rolling direction and including a roll axis A2, which is a point of effort of the rolling direction force of the lower work roll 2 in the draft direction of the lower work roll 2, is interposed between the load detection devices 23*a* and 23*b*.

The two load detection devices 23*a* and 23*b* of the rolling direction force measurement device 23 are connected to a lower work roll chock exit side load calculation device 33 as shown in FIG. 6. The load calculation device 33 adds up loads detected by the load detection devices 23*a* and 23*b*. In this way, a rolling direction force applied to the exit side project block 11 from the lower work roll chock 6, that is, a rolling direction force of the lower work roll chock 6 toward the exit side is calculated.

In the same manner, the lower work roll chock entry side rolling direction force measurement device 24 includes a first load detection device 24*a* and a second load detection device 24*b*. The load detection devices 24*a* and 24*b* are both disposed on the entry side project block 12. Further, as shown in FIG. 8, the load detection devices 24*a* and 24*b* are disposed in a manner that a line extending in the rolling direction and including the roll axis A2, which is a point of effort of the rolling direction force of the lower work roll 2 in the draft direction of the lower work roll 2, is interposed between the load detection devices 24*a* and 24*b*.

The two load detection devices 24*a* and 24*b* of the rolling direction force measurement device 24 are connected to a lower work roll chock entry side load calculation device 34 as shown in FIG. 6. The load calculation device 34 adds up loads detected by the load detection devices 24*a* and 24*b*. In this way, a rolling direction force applied to the entry side project block 12 from the lower work roll chock 6, that is, a rolling direction force of the lower work roll chock 6 toward the entry side is calculated.

Next, functions and effects of the thus constructed rolling apparatus will be described.

Taking the upper work roll chock 5 as an example, according to the present embodiment as described above, the two load detection devices 21*a* and 21*b* are always disposed in a manner that the load detection devices 21*a* and 21*b* face the side surface of the exit side of the upper work roll chock 5. Accordingly, the side surface of the exit side of the upper work roll chock 5 is always supported at multiple points in the draft direction. In this case, the load detection devices 21*a* and 21*b* are disposed in a manner that a line extending in the rolling direction and including the roll axis A1, which is the point of effort of the rolling direction force of the upper work roll 1 in the draft direction of the upper work roll 1, is interposed between the load detection devices 21*a* and 21*b*. In the same manner, according to the present embodiment, the two load detection devices 22*a* and 22*b* are always disposed in a manner that the load detection devices 22*a* and 22*b* face the side surface of the entry side of the upper work roll chock 5. Accordingly, the side surface of the entry side of the upper work roll chock 5 is always supported at multiple points in the draft direction. In this case, the load detection devices 22*a* and 22*b* are also disposed in a manner that a line extending in the rolling direction and including the roll axis A1, which is the point of effort of the rolling direction force of the upper work roll 1 in the draft direction of the upper work roll 1, is interposed between the load detection devices 22*a* and 22*b*.

Figure 1:
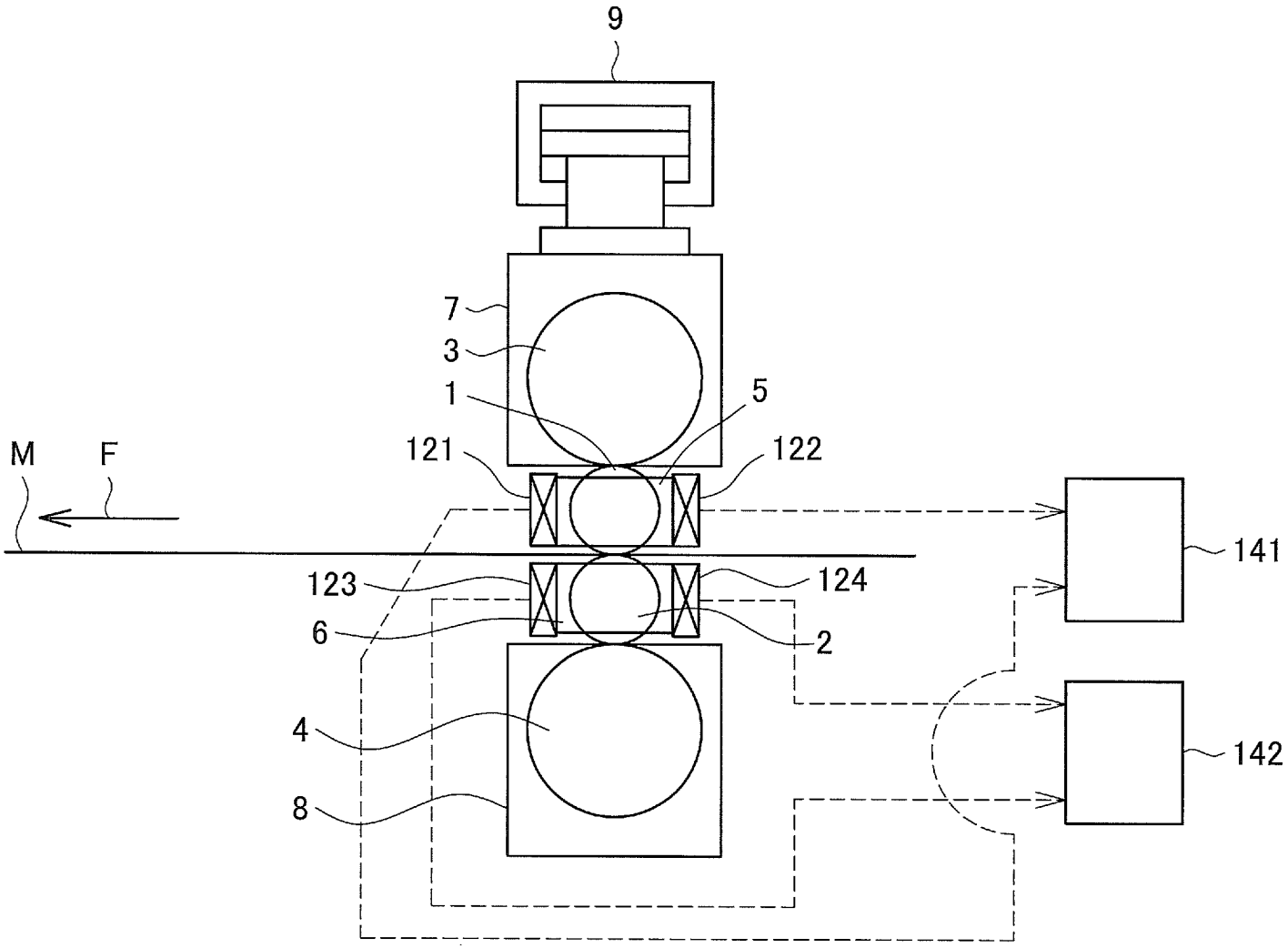
FIG. 1 is a view schematically showing a rolling apparatus having load detection devices of prior art.
Figure 2:
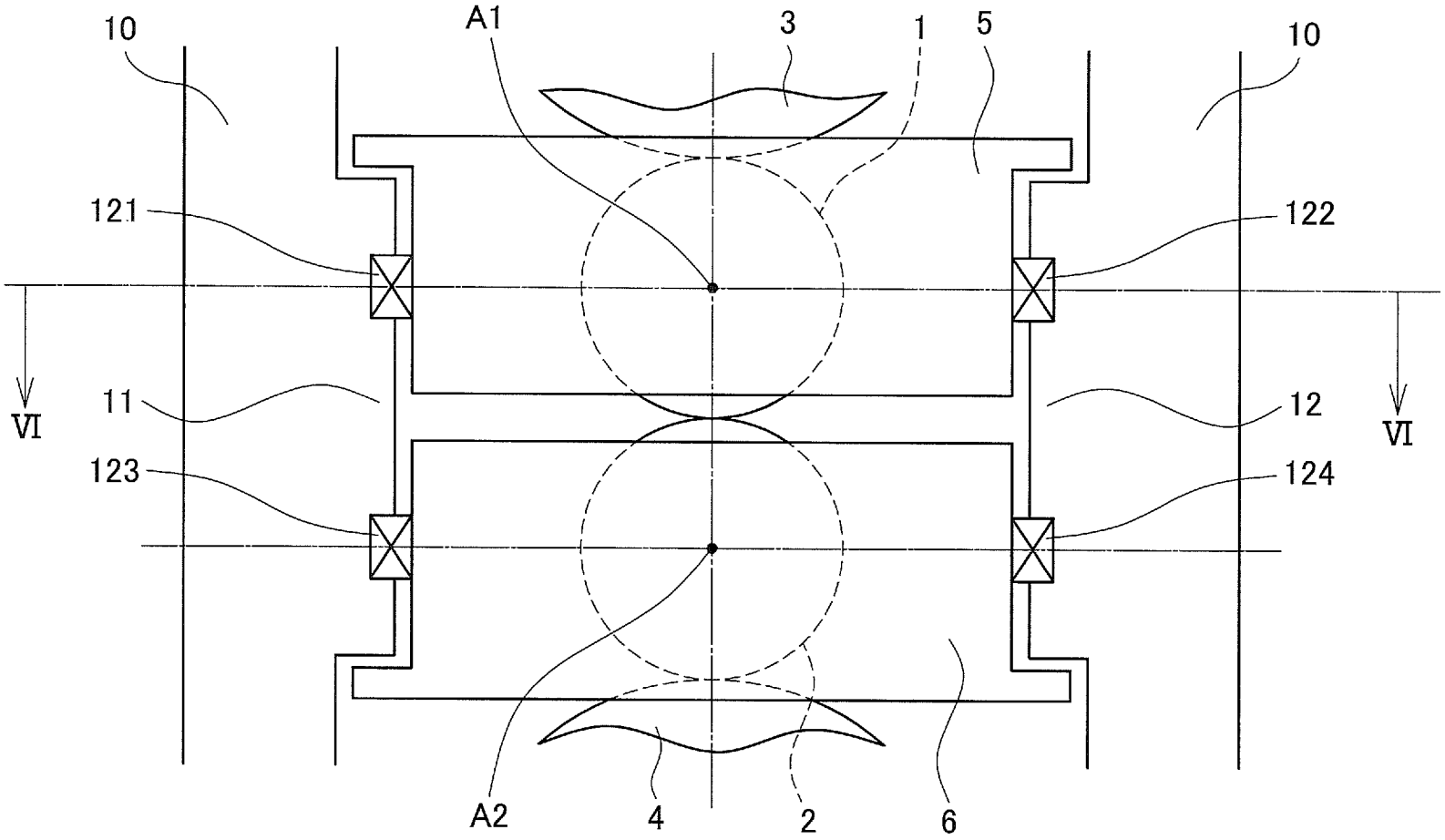
FIG. 2 is a side view schematically showing work roll chocks having load detection devices of prior art and a periphery thereof.
Figure 3:
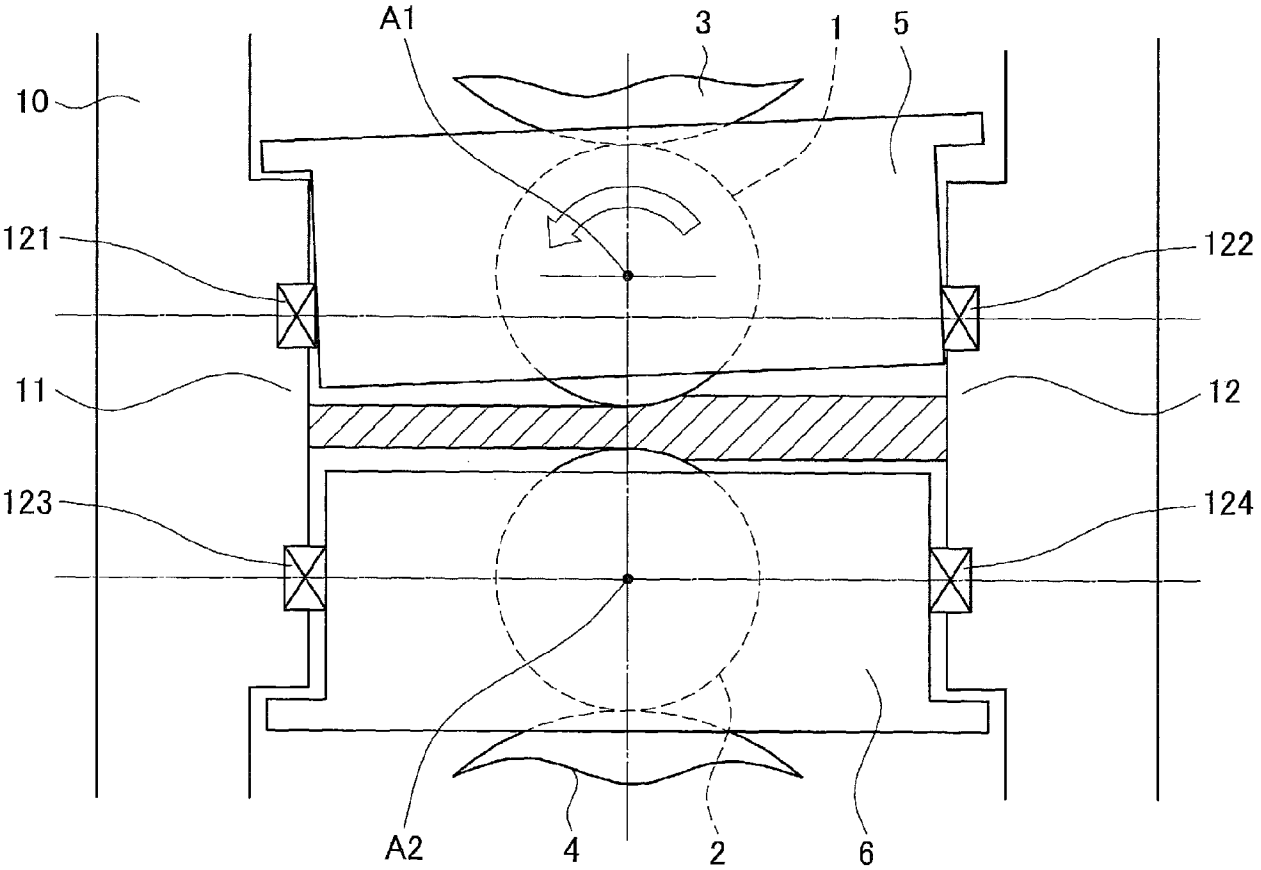
FIG. 3 is a side view illustrating a problem to be solved in measuring rolling direction forces by rolling load detection devices of prior art, and shows a state in which a roll axis of an upper work roll shifts with respect to positions of the rolling load detection devices in a draft direction and in which an upper work roll chock tilts.

For example, as shown in FIG. 9, let us assume that the upper work roll 1 rises and a gap between the work rolls 1 and 2 increases. In this case, the position of the roll axis A1 of the upper work roll 1 in the draft direction rises, the relative positional relation between the roll axis A1 of the upper work roll 1 and the load detection devices 21*a*, 21*b*, 22*a*, and 22*b* differs from the state shown in FIG. 8. Accordingly, the moment acts on the upper work roll chock 5 in the same direction as the direction indicated by an arrow shown in FIG. 3. However, even if such moment acts on the upper work roll chock 5, the upper work roll chock 5 does not tilt as shown in FIG. 3, since the upper work roll chock 5 is being supported at multiple points that are shifted in the draft direction. Therefore, the upper work roll chock 5 does not come into contact with the housing 10. Consequently, even if the gap between the work rolls 1 and 2 increases, the rolling direction force of the upper work roll chock 5 toward the exit side can be accurately detected by the exit side load detection devices 21*a* and 21*b*, and the rolling direction force of the upper work roll chock 5 toward the entry side can be accurately detected by the entry side load detection devices 22*a* and 22*b*.

Further, for example, let us assume that the work rolls 1 and 2 and the backup rolls 3 and 4 are worn away and decrease in the roll diameters. In this case, as shown in FIG. 10, the upper work roll chock 5 and the lower work roll chock 6 move downward in the draft direction. Accordingly, the relative positional relation between the axis A1 of the upper work roll 1 and the load detection devices 21*a*, 21*b*, 22*a*, and 22*b* in the draft direction differs from the states shown in FIG. 8 and FIG. 9. In the same manner, the relative positional relation between the axis A2 of the lower work roll 2 and the load detection devices 23*a*, 23*b*, 24*a*, and 24*b* in the draft direction differs from the states shown in FIG. 8 and FIG. 9. Accordingly, the moment acts on the upper work roll chock 5 and the lower work roll chock 6 in the same direction as the direction indicated by an arrow shown in FIG. 4.

However, similarly as the case shown in FIG. 9, even if such moment acts on the work roll chocks 5 and 6, the work roll chocks 5 and 6 do not tilt as shown in FIG. 4, since the work roll chocks 5 and 6 are each being supported at multiple points in the draft direction. Therefore, the work roll chocks 5 and 6 do not come into contact with the housing 10 and the project blocks 11 and 12. Consequently, even if the work rolls 1 and 2 and the backup rolls 3 and 4 are worn away and decrease in the roll diameters, the rolling direction forces of the work roll chocks 5 and 6 can be accurately detected.

Note that, in the embodiments described above, the rolling direction force measurement devices 21, 22, 23, and 24 each have two load detection devices which are disposed with predetermined spaces therebetween in the draft direction. However, the present invention is not limited such an example, and the rolling direction force measurement devices may each have three or more load detection devices which are disposed with a predetermined space therebetween in the draft direction. Also in this case, the load detection devices of each the rolling direction force measurement device are always disposed in a manner that at least two load detection devices face a side surface of a work roll chock even if the position of the work roll chock changes in the draft direction. In this case, at least two load detection devices are always disposed in a manner that a line extending in the rolling direction and including a roll axis, which is a point of effort of the rolling direction force, is interposed between the at least two load detection devices. Note that it is preferred that the load detection devices of each of the rolling direction force measurement devices be disposed such that the load detection devices are spaced apart as much as possible from each other within the above range.

FIG. 11 shows an example in which the rolling direction force measurement device 21 has three load detection devices 21*a*, 21*b*, and 21*c*, and the rolling direction force measurement device 22 has three load detection devices 22*a*, 22*b*, and 22*c*. As seen from FIG. 11, when the number of load detection devices increases, it becomes easier to make at least two load detection devices always face a side surface of a work roll chock even if the roll gap increases remarkably compared to the case of FIG. 10. Accordingly, the rolling direction force can be accurately determined even in the case where the roll gap is increased remarkably.

1-2. Second Construction Example

Next, on the basis of FIG. 12, a second construction example of a rolling apparatus according to an embodiment of the present invention will be described. In the rolling apparatus according to the present embodiment, multiple load detection devices, which are disposed in the draft direction of a work roll, are disposed in a manner that the load detection devices are shifted in the roll axis direction of the work roll compared with the first construction example. Note that FIG. 12 is an enlarged cross-sectional plan view of a work roll chock and the periphery thereof taken along the line XII-XII of FIG. 8.

As shown in FIG. 12, in the rolling apparatus according to the present embodiment, the load detection devices 21*a* and 21*b* of the upper work roll chock exit side rolling direction force measurement device 21 are disposed in a manner that the load detection devices 21*a* and 21*b* are shifted from each other in the roll axis direction. Further, the load detection devices 22*a* and 22*b* of the upper work roll chock entry side rolling direction force measurement device 22 are also disposed in a manner that the load detection devices 22*a* and 22*b* are shifted from each other in the roll axis direction.

The following description will be made using the load detection devices 21*a* and 21*b* of the upper work roll chock exit side rolling direction force measurement device 21 as examples. In a rolling apparatus capable of performing roll shifting, the position of the upper work roll chock 5 in the roll axis direction may change owing to shift roll at the time of rolling the flat-rolled metal material M. In this case, in the rolling apparatus according to the present embodiment, even if the positions of the load detection devices 21*a* and 21*b* of the upper work roll chock 5 in the roll axis direction change, the two load detection devices 21*a* and 21*b* are always disposed in a manner that the load detection devices 21*a* and 21*b* face a side surface of the upper work roll chock 5.

It is preferred that the load detection devices 21*a* and 21*b* be disposed in a manner that a line extending in the rolling direction and including the center of a radial bearing 5*a*, which is a point of effort of the rolling direction force, is interposed between the load detection devices 21*a* and 21*b*. That is, even if the position of the upper work roll chock 5 in the roll axis direction changes, one of the load detection devices, that is, the load detection device 21*a*, is always disposed in a manner that the load detection device 21*a* faces the side surface of the upper work roll chock 5 at an upper work roll 1 side with respect to the center (line C shown in the figure) of the radial bearing 5*a* provided to the upper work roll chock 5 in the roll axis direction. Further, the other load detection device, that is, the load detection device 21*b*, is disposed in a manner that the load detection device 21*b* faces the side surface of the upper work roll chock 5 at the side opposite to the upper work roll 1 side with respect to the center C of the radial bearing 5*a* in the roll axis direction.

Note that, although the rolling direction force measurement devices 21 and 22 of the upper work roll chock 5 have been described in the above description based on FIG. 12, the rolling direction force measurement devices 23 and 24 of the lower work roll chock 6 can have a similar construction.

Functions and effects of the rolling apparatus constructed as shown in FIG. 12 will be described. Taking the upper work roll chock 5 as an example, in the rolling apparatus according to the present embodiment as described above, the two load detection devices 21*a* and 21*b* are always disposed in a manner that the load detection devices 21*a* and 21*b* face the side surface of the exit side of the work roll chock 5. Accordingly, the side surface of the exit side of the upper work roll chock 5 is always supported at multiple points in the roll axis direction. In the same manner, according to the present embodiment, the two load detection devices 22*a* and 22*b* are always disposed in a manner that the load detection devices 22*a* and 22*b* face the side surface of the entry side of the upper work roll chock 5. Accordingly, the side surface of the entry side of the upper work roll chock 5 is also always supported at multiple points in the roll axis direction.

For example, as shown in FIG. 12, when the upper work roll 1 moves owing to roll shifting for a shift quantity D in the roll axis direction, the relative positional relation between the center C of radial bearing 5*a* of the upper work roll chock 5 and the load detection devices 21*a*, 21*b*, 22*a*, and 22*b* in the roll axis direction changes. Accordingly, the moment acts on the upper work roll chock 5. However, even if such moment acts on the upper work roll chock 5, the upper work roll chock 5 does not tilt as shown in FIG. 5, since the upper work roll chock 5 is being supported at multiple points in the roll axis direction. Consequently, even if the upper work roll 1 moves owing to roll shifting in the roll axis direction, the rolling direction force of the upper work roll chock 5 can be accurately detected.

Note that, in the present embodiment, the multiple entry side load detection devices of the entry side rolling direction force measurement device are disposed at the same positions in the draft direction and in the roll axis direction as the multiple exit side load detection devices of the exit side rolling direction force measurement device. However, it is not necessary that the positions of the load detection devices in the draft direction and in the roll axis direction be the same. Note that, however, when the positions of the load detection devices in the draft direction and in the roll axis direction are the same, a rolling direction force can be calculated more accurately with a smaller number of load detection devices, since functions of both directions can be given to one load detection device.

1-3. Third Construction Example

Next, on the basis of FIG. 13, a third construction example of a rolling apparatus according to an embodiment of the present invention will be described. The rolling apparatus according to the present embodiment differs from the rolling apparatus of the first construction example in that at least one of rolling direction force measurement devices provided to the rolling apparatus includes one load detection device. That is, the rolling apparatus according to the first construction example includes, as shown in FIG. 8 for example, the rolling direction force measurement devices 21 and 22 for the upper work roll chock 5 and the rolling direction force measurement devices 23 and 24 for the lower work roll chock 6 each have multiple load detection devices. In contrast, in the rolling apparatus according to the present construction example, all the rolling direction force measurement devices may not each have multiple load detection devices.

For example, it is highly likely that the upper work roll chock 5 tilts due to a change in a roll gap or a roll diameter. Accordingly, as shown in FIG. 13, only the rolling direction force measurement devices 21 and 22 for the upper work roll chock 5, which is more likely to be tilted, may each have multiple load detection devices. On the other hand, the rolling direction force measurement devices 23 and 24 for the lower work roll chock 6, whose pass line heights are always adjusted and which hardly receive an influence caused by a change in a roll diameter, may each have only one load detection device.

In this way, in the rolling apparatus according to the present embodiment, at least one of the rolling direction force measurement devices 21, 22, 23, and 24 may have multiple load detection devices. A rolling direction force measurement device of a work roll chock which is more likely to be tilted is preferentially provided with multiple load detection devices, and thus, the rolling direction force of the rolling apparatus can be measured stably in general, while reducing the cost.

1-4. Fourth Construction Example

Next, a fourth construction example of a rolling apparatus according to an embodiment of the present invention will be described. The rolling apparatuses of the first to third construction examples described above are each provided with the rolling direction force measurement device at each of the both sides, that is, the rolling direction entry side and the rolling direction exit side, of each of the work roll chocks 5 and 6. However, for example, in the case where the axis of the work roll is offset with respect to the axis of the backup roll in the rolling direction to forcedly apply the rolling direction force to the work roll, or in the case where pressing means for biasing the work roll chock in the rolling direction is installed to forcedly apply the rolling direction force to the work roll chock, it is not necessary to provide the rolling direction force measurement device to each of the both rolling direction entry side and rolling direction exit side.

For example, only the rolling direction force measurement devices 21 and 23 at the rolling direction exit side may be provided and the rolling direction force measurement devices 22 and 24 at the rolling direction entry side may not be provided. On the contrary, only the rolling direction force measurement devices 22 and 24 at the rolling direction entry side may be provided and the rolling direction force measurement devices 21 and 23 at the rolling direction exit side may not be provided. In anyway, in the rolling apparatus according to an embodiment of the present invention, as long as there is provided at least one of the rolling direction force measurement devices 21, 22, 23, and 24, it is not necessary that other rolling direction force measurement devices be provided.

1-5. Fifth Construction Example

Next, a fifth construction example of a rolling apparatus according to an embodiment of the present invention will be described. In the first construction example, as shown in FIG. 7, the main body of the rolling apparatus has the construction in which the side surfaces of the upper work roll chock 5 face the housing 10 having no project blocks 11 and 12 disposed thereon, and the side surfaces of the lower work roll chock 6 face the project blocks 11 and 12. However, the main body of the rolling apparatus may not necessarily have such a construction.

For example, as shown in FIG. 14, the rolling apparatus of the present construction example has the construction in which the side surfaces of both the work roll chocks 5 and 6 face the project blocks 11 and 12. In this case, as shown in FIG. 14, the load detection devices of the rolling direction force measurement devices 21 and 22 are not disposed on the housing 10, but on the project blocks 11 and 12. Alternatively, the rolling apparatus may also have the construction in which the side surfaces of both the work roll chocks 5 and 6 face the housing 10 having no project blocks 11 and 12 disposed thereon.

1-6. Sixth Construction Example

Next, a sixth construction example of a rolling apparatus according to an embodiment of the present invention will be described. As shown in FIG. 15, the rolling apparatus of the present construction example is provided with covers 25, 26, 27, and 28 each covering surfaces of two adjacent load detection devices. Note that parts for fixing the covers and waterproofing treatment for preventing water from entering into the inner side of the load detection device are necessary, but are not shown in FIG. 15.

In this case, for example, the upper work roll chock 5 is supported by the cover 25 covering the load detection devices 21*a* and 21*b* and the cover 26 covering the load detection devices 22*a* and 22*b*. In the same manner, the lower work roll chock 6 is supported by the cover 27 covering the load detection devices 23*a* and 23*b* and the cover 28 covering the load detection devices 24*a* and 24*b*. In this case, with increase in lengths L of the covers 25, 26, 27, and 28 in the draft direction, the areas being in contact with the side surfaces of the work roll chocks 5 and 6 increase, and sufficient contact lengths with the work roll chocks can be always maintained. In this way, the tilts of the work roll chocks 5 and 6 can be prevented. For example, there may be a case where there is no sufficient space between two load detection devices in the draft direction depending on the shape and structure (including inner structure) of the housing and the project block. In this case, the same effect of the work roll chock-tilt prevention can be obtained by providing the cover to the load detection devices.

Note that, in the example shown in FIG. 15, all load detection devices that form one rolling direction force measurement device are covered by a cover, but the present invention is not limited thereto. For example, each of the load detection device that form a rolling direction force measurement device may be covered by a cover separately, or multiple load detection devices that form a rolling direction force measurement device may be covered by one cover.

1-7. Conclusion

Heretofore, the construction examples of the rolling apparatuses according to the present embodiment have been described. In a rolling apparatus of the present embodiment, at least one rolling direction force measurement device has two load detection devices which are always disposed in the draft direction of a work roll in a manner that the load detection devices face a side surface of the work roll chock on a housing or a project block. In this case, the load detection devices are disposed in a manner that a line extending in the rolling direction and including a roll axis, which is a point of effort of the rolling direction force of the work roll in the draft direction of the work roll, is interposed between the load detection devices. In this way, the side surface of the work roll chock is always supported at multiple points in the draft direction, the multiple points having a line extending in the rolling direction and including the point of effort of the rolling direction force interposed therebetween, and thus, the tilt of the work roll chock can be prevented.

Further, in the rolling apparatus, at least one rolling direction force measurement device may have two load detection devices which are always disposed in the roll axis direction of a work roll in a manner that the load detection devices face a side surface of the work roll chock on a housing or a project block. In this case, the load detection devices are disposed in a manner that a line extending in the rolling direction and including the center of a radial bearing, which is a point of effort of the rolling direction force of the work roll in the roll axis direction of the work roll, is interposed between the load detection devices. In this way, the side surface of the work roll chock is always supported at multiple points in the roll axis direction, the multiple points having a line extending in the rolling direction and including the point of effort of the rolling direction force interposed therebetween, and thus, the tilt of the work roll chock can be prevented.

It is not necessary that multiple load detection devices be disposed in both the draft direction and the roll axis direction. The multiple load detection devices may be disposed in a manner that they are shifted either only in the draft direction or only in the roll axis direction. That is, as long as the length of contact between the load detection device and the work roll chock in the draft direction or in the roll axis direction is sufficient and no tilt is likely to occur, it is not necessary to provide multiple load detection devices in that direction. Consequently, multiple load detection devices may be disposed in the draft direction and one load detection device may be disposed in the roll axis direction, for example.

When a rolling direction force measurement device of a rolling apparatus has multiple load detection devices in the draft direction and multiple load detection devices in the roll axis direction, three load detection devices 22*a*, 22*b*, and 22*c* are disposed in a triangular shape as shown in FIG. 16, and thus, a movement in a tilting manner of the work roll chock 5 can be prevented and the rolling direction force can be detected with high accuracy. That is, two load detection devices 22*a* and 22*c* are disposed above the roll axis A1 of the work roll 1 in the draft direction, and the load detection device 22*b* is disposed below the roll axis A1 of the work roll 1 in the draft direction. Further, two load detection devices 22*a* and 22*c* are disposed in a manner that a line extending in the rolling direction and including the center C of a radial bearing 5*a*, which is a point of effort of the rolling direction force in the roll axis direction, is interposed between the load detection devices 22*a* and 22*c*.

When the load detection devices 22*a*, 22*b*, and 22*c* are arranged in this manner, the point of effort of the rolling direction force is located within an area S having a triangular shape defined by connecting three load detection devices 22*a*, 22*b*, and 22*c*. Accordingly, even if the work roll 1 moves in the draft direction or in the roll axis direction, at least two load detection devices are always supporting the work roll chock 5 in the state of interposing therebetween the point of effort of the rolling direction force, and thus, the tilt of the work roll chock can be prevented. Note that two load detection devices 22*a* and 22*c* are disposed above the roll axis A1 of the work roll 1 in the draft direction in FIG. 16, but the present invention is not limited thereto, and multiple load detection devices may be disposed above the roll axis A1.

In order for the rolling direction force measurement device having multiple load detection devices to reliably prevent the tilt of the work roll chock in the draft direction and in the roll axis direction, it is preferred to dispose at least three load detection devices as shown in FIG. 16. In this case, the number of load detection devices may be three or more, and, for example, as shown in FIG. 17, four load detection devices may be disposed in a quadrilateral shape.

That is, as shown in FIG. 17, two load detection devices 22*a* and 22*c* are disposed above the roll axis A1 of the work roll 1 in the draft direction, and two load detection devices 22*b* and 22*d* are disposed below the roll axis A1 of the work roll 1 in the draft direction. Further, the two load detection devices 22*a* and 22*c* and the two load detection devices 22*b* and 22*d* are disposed in a manner that a line extending in the rolling direction and including the center C of a radial bearing 5*a*, which is a point of effort of the rolling direction force in the roll axis direction, is interposed between the load detection devices 22*a* and 22*c* and between the load detection devices 22*b* and 22*d*.

In this manner, the point of effort of the rolling direction force is located within an area S having a quadrilateral shape defined by connecting four load detection devices 22*a*, 22*b*, 22*c*, and 22*d*. Accordingly, even if the work roll 1 moves in the draft direction or in the roll axis direction, at least two load detection devices are always supporting the work roll chock 5 in the state of interposing therebetween the point of effort of the rolling direction force, and thus, the tilt of the work roll chock can be prevented.

Note that, although the shape of the area S having the point of effort of the rolling direction force located therein is a triangle in FIG. 16 and is a rectangle in FIG. 17, the present invention is not limited thereto, and the shape may be a trapezium, a rhombus, or other polygons, for example.

2. Method of Controlling Rolling Apparatus

Next, there will be described a method of controlling a rolling apparatus on the basis of the thus detected rolling direction force.

As shown in FIG. 6, the upper work roll chock exit side load calculation device 31 and the upper work roll chock entry side load calculation device 32 are connected to an upper work roll chock rolling direction force calculation device 41. The upper work roll chock rolling direction force calculation device 41 calculates a difference of a calculation result obtained by the upper work roll chock exit side load calculation device 31 and a calculation result obtained by the upper work roll chock entry side load calculation device 32, and, on the basis of the calculation result, calculates the rolling direction force acting on the upper work roll chock 5.

In the same manner, the lower work roll chock exit side load calculation device 33 and the lower work roll chock entry side load calculation device 34 are connected to a lower work roll chock rolling direction force calculation device 42. The lower work roll chock rolling direction force calculation device 42 calculates a difference of a calculation result obtained by the lower work roll chock exit side load calculation device 33 and a calculation result obtained by the lower work roll chock entry side load calculation device 34, and, on the basis of the calculation result, calculates the rolling direction force on the lower work roll chock 6.

In the case of controlling a zigzag movement and a camber, an operator side work roll chock rolling direction force calculation device 43 calculates the sum of the calculation result of the upper work roll chock rolling direction force calculation device 41 and the calculation result of the lower work roll chock rolling direction force calculation device 42, to calculate the rolling direction resultant force acting on the upper work roll 1 and the lower work roll 2 on the operator side. The calculation processing described above is conducted not only for the operator side but also for the driving side by using entirely the same device construction (not shown), and the rolling direction resultant force acting on the upper work roll 1 and the lower work roll 2 on the driving side is calculated by a driving side work roll chock rolling direction force calculation device 44.

After that, an operator side/driving side rolling direction force calculation device 45 calculates the difference between the calculation results on the operator side and the calculation results on the driving side, and in this way, the difference of the rolling direction forces acting on the upper and lower work roll chocks between the operator side and the driving side is calculated.

Next, a control quantity calculation device 46 sets the difference of the rolling direction forces acting on the work roll chocks 5 and 6 between the operator side and the driving side to a suitable target value and calculates a left-right swivelling component control quantity of the roll gap of the rolling mill on the basis of the calculation result of the difference of the rolling direction forces between the operator side and the driving side for preventing the camber. Here, the control quantity is calculated by PID calculation that takes a proportional (P) gain, an integration (I) gain, and a differential (D) gain into consideration, for example, on the basis of the left-right difference of the rolling direction force. A control device 47 controls the left-right swivelling component of the roll gap of the rolling mill on the basis of this control quantity calculation result. In this way, rolling free from the occurrence of camber or having extremely slight camber can be accomplished.

Note that, in the calculation processing described above, only addition and subtraction are basically done on the outputs of 16 load detection devices on both operator side and driving side before the calculation result of the operator side/driving side rolling direction force calculation device 45 is obtained. Therefore, the sequence of calculation processing described above may be arbitrarily changed. For example, it is possible to first add the outputs of the upper and lower exit side load detection devices, then to calculate the difference from the addition result on the entry side and to finally calculate the difference between the operator side and the driving side. Alternatively, it is possible to first calculate the difference of the outputs of the load detection devices at the respective positions on the operator side and the driving side, then to calculate the sum of the upper and lower detection devices and to finally calculate the difference between the entry side and the exit side.

In the case of controlling a warp, the operator side work roll chock rolling direction force calculation device 43 calculates the difference between the calculation result of the upper work roll chock rolling direction force calculation device 41 and the calculation result of the lower work roll chock rolling direction force calculation device 42, to calculate the difference of the rolling direction forces acting on the work roll chocks on the operator side between the upper side and the lower side. The calculation processing described above is conducted not only for the operator side but also for the driving side by using entirely the same device construction (not shown), and the difference of the rolling direction forces acting on the work roll chocks on the driving side between the upper side and the lower side is calculated by the driving side work roll chock rolling direction force calculation device 44. The operator side/driving side rolling direction force calculation device 45 totalizes the calculation results on the operator side and the calculation results of the driving side (difference between the upper side and the lower side), and in this way, the difference of the rolling direction forces acting on the work roll chocks between the upper side and the lower side is calculated.

Next, the control quantity calculation device 46 sets the difference of the rolling direction forces acting on the work roll chocks between the upper side and the lower side to a suitable target value and calculates an upper side-lower side swivelling component control quantity of a roll speed of the rolling mill on the basis of the calculation result of the difference of the rolling direction forces between the upper side and the lower side for preventing the warp. Here, the control quantity is calculated by PID calculation that takes a proportional (P) gain, an integration (I) gain, and a differential (D) gain into consideration, for example, on the basis of the upper side-lower side rolling direction force.

Then, the control device 47 controls the upper side-lower side swivelling component control quantity of the roll speed of the upper drive electric motor 35 and the lower drive electric motor 36 of the rolling mill on the basis of this control quantity calculation result. In this way, rolling free from the occurrence of warp or having extremely slight warp can be accomplished.

Note that, although the roll speed of the rolling mill is used here as the upper side-lower side swivelling component control quantity, a frictional coefficient between a rolling roll and a material to be rolled, a difference in temperature of a material to be rolled between the upper surface and the lower surface, an angle of incidence of a material to be rolled, a position of the work roll chock in the horizontal direction, top and bottom rolling torques, or the like may be also used.

In the case of zero point adjustment, after going through the same processes as the calculation processes of the zigzag movement and camber control described above, the operator side/driving side rolling direction force calculation device 45 calculates the difference between the calculation results on the operator side and the calculation results on the driving side, and in this way, calculates the difference of the rolling direction forces acting on the work roll chocks between the operator side and the driving side.

Then, the hydraulic screw down devices 9 are operated simultaneously on the operator side and on the driving side and are tightened until the sum of right and left counter-forces of a backup roll is equal to a preset value (zero point adjustment load), and, under that state, leveling operation for rendering the difference of the rolling direction forces between the operator side and the driving side zero is executed.

Subsequently, the control quantity calculation device 46 calculates the control quantity of the hydraulic screw down device 9 such that the difference of the rolling direction forces acting on the work roll chocks 5 and 6 between the operator side and the driving side become zero and that the zero point adjustment load is maintained, on the basis of the results of the difference of the rolling direction forces between the operator side and the driving side (difference between the operator side and the driving side) calculated by the operator side/driving side rolling direction force calculation device 45. Then, the control device 47 controls the reduction position of a roll of the rolling mill on the basis of the control quantity calculation result. In this way, the difference of the rolling direction forces acting on the work roll chocks between the operator side and the driving side is set to zero, and the reduction position at that point is set as the zero point of the reduction position of the operator side and the driving side individually.

Note that, as described above, the difference of the rolling direction forces acting on the work roll chocks (upper work roll chock 5 and lower work roll chock 6) between the operator side and the driving side is not influenced by a roll thrust force. Therefore, even if a thrust force occurs between the rolls, the zero point setting of the reduction leveling can be accomplished with extremely high accuracy.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

Note that, in the embodiments described above, there has been used a four high rolling mill having only the work rolls and the backup rolls for the description, but the present invention is not limited thereto. The technology according to the present invention can be also applied to a six high rolling mill which has intermediate rolls, for example.

REFERENCE SIGNS LIST

1 upper work roll
2 lower work roll
3 upper backup roll
4 lower backup roll
5 upper work roll chock (operator side)
6 lower work roll chock (operator side)
7 upper backup roll chock (operator side)
8 lower backup roll chock (operator side)
9 screw down device
10 housing
11 exit side project block (operator side)
12 entry side project block (operator side)
21 upper work roll chock exit side rolling direction force measurement device (operator side)
21*a* first load detection device on exit side of upper work roll chock
21*b* second load detection device on exit side of upper work roll chock
22 upper work roll chock entry side rolling direction force measurement device (operator side)
22*a* first load detection device on entry side of upper work roll chock

22*b* second load detection device on entry side of upper work roll chock
23 lower work roll chock exit side rolling direction force measurement device (operator side)
23*a* first load detection device on exit side of lower work roll chock
23*b* second load detection device on exit side of lower work roll chock
24 lower work roll chock entry side rolling direction force measurement device (operator side)
24*a* first load detection device on entry side of lower work roll chock
24*b* second load detection device on entry side of lower work roll chock
25 cover shared between first and second load detection devices on exit side of upper work roll chock (operator side)
26 cover shared between first and second load detection devices on entry side of upper work roll chock (operator side)
27 cover shared between first and second load detection devices on exit side of lower work roll chock (operator side)
28 cover shared between first and second load detection devices on entry side of lower work roll chock (operator side)
31 upper work roll chock exit side load calculation device (operator side)
32 upper work roll chock entry side load calculation device (operator side)
33 lower work roll chock exit side load calculation device (operator side)
34 lower work roll chock entry side load calculation device (operator side)
35 upper drive electric motor
36 lower drive electric motor
41 upper work roll chock rolling direction force calculation device (operator side)
42 lower work roll chock rolling direction force calculation device (operator side)
43 operator side work roll chock rolling direction force calculation device
44 driving side work roll chock rolling direction force calculation device
45 operator side/driving side rolling direction force calculation device
46 control quantity calculation device
47 control device
121 upper work roll chock exit side load detection device
122 upper work roll chock entry side load detection device
123 lower work roll chock exit side load detection device
124 lower work roll chock entry side load detection device
141 upper work roll rolling direction force calculation device
142 lower work roll rolling direction force calculation device

The invention claimed is:

1. A rolling apparatus for a flat-rolled metal material, the rolling apparatus comprising:

a pair of work rolls including an upper work roll and a lower work roll;

a pair of backup rolls including an upper backup roll and a lower backup roll, the pair of backup rolls supporting the pair of work rolls;

a pair of work roll chocks configured to hold the respective work rolls;

a pair of backup roll chocks configured to hold the pair of backup rolls;

housings or project blocks configured to hold the work roll chocks; and one or more rolling direction force measurement devices configured to measure rolling direction forces acting on a respective work roll chock, wherein at least one of the rolling direction force measurement devices includes a plurality of load detection devices on an entry side or an exit side of one of the work roll chocks in a rolling direction, each of the plurality of load detection devices contacting a side surface of one of the pair of work roll chocks, and the plurality of load detection devices of the at least one of the rolling direction force measurement devices are provided to one of the housings or one of the project blocks, and wherein the plurality of load detection devices are disposed in a manner that, on all occasions, a line extending in the rolling direction and including a roll axis which is a point of effort of the rolling direction force of one of the work rolls is interposed between at least two of the plurality of load detection devices in a draft direction, and the at least two of the plurality of load detection devices face a side surface of a corresponding one of the work roll chocks.

2. The rolling apparatus according to claim 1, wherein, in at least one of the rolling direction force measurement devices, the load detection devices are disposed in a manner that, on all occasions, a line extending in the rolling direction and including a center of a radial bearing, which is the point of effort of the rolling direction force of one of the work rolls is interposed between at least two of the load detection devices in a roll axis direction of the work rolls, and the at least two of the load detection devices face the side surface of a corresponding one of the work roll chocks.

3. The rolling apparatus according to claim 1, wherein at least one of the rolling direction force measurement devices includes at least three load detection devices on the entry side or the exit side of the work roll chocks in a rolling direction, and the at least three load detection devices are provided to one of the housings or one of the project blocks, and wherein the load detection devices are disposed so as to be shifted in one of the draft direction and the roll axis direction of the work rolls, in a manner that the point of effort of the rolling direction force of each of the work rolls is located within an area defined by connecting the load detection devices.

4. The rolling apparatus according to claim 1, further comprising:

a rolling direction force calculation device configured to calculate a rolling direction force by adding up loads of the one or more rolling direction force measurement devices each including the plurality of load detection devices, the loads being detected by the respective load detection devices.

5. The rolling apparatus according to claim 1, wherein the rolling apparatus is provided with the rolling direction force measurement devices on an exit side of an upper work roll chock, an entry side of the upper work roll chock, an exit side of a lower work roll chock, and an entry side of the lower work roll chock, respectively.

6. The rolling apparatus according to claim 5, wherein, out of the rolling direction force measurement devices, the plurality of load detection devices are provided only to the one or more rolling direction force measurement devices configured to measure any one of a rolling direction force acting in a rolling direction on the exit side and a rolling direction force acting in a rolling direction on the entry side.

7. The rolling apparatus according to claim 5, wherein all of the rolling direction force measurement devices each have the plurality of load detection devices.

8. The rolling apparatus according to claim 5, wherein, out of the rolling direction force measurement devices, the plurality of load detection devices are provided only to the one or more rolling direction force measurement devices for any one of the upper work roll chock and the lower work roll chock.

9. The rolling apparatus according to claim 7, wherein the plurality of load detection devices are disposed in a manner that positions in a draft direction and positions in a roll axis direction of the plurality of load detection devices provided on the entry side in the rolling direction are identical to positions in a draft direction and positions in a roll axis direction of the plurality of load detection devices provided on the exit side in the rolling direction.

10. The rolling apparatus according to claim 7, wherein the rolling direction force calculation device calculates a rolling direction force on the basis of an entry side load calculated by adding up loads detected by the plurality of load detection devices provided on the entry side in the rolling direction and an exit side load calculated by adding up loads detected by the plurality of load detection devices provided on the exit side in the rolling direction.

11. The rolling apparatus according to claim 1, wherein the load detection devices are each a load cell.

12. The rolling apparatus according to claim 1, further comprising:

a cover configured to cover each of the load detection devices, the cover being provided between one of the housings or one of the project blocks and each of the load detection devices.

13. The rolling apparatus according to claim 1, further comprising:

a cover configured to collectively cover the load detection devices for each of the rolling direction force measurement devices, the cover being provided between one of the housings or one of the project blocks and each of the load detection devices.

14. The rolling apparatus according to claim 2, further comprising:

a rolling direction force calculation device configured to calculate the rolling direction force by adding up loads of the one or more rolling direction force measurement devices each including the plurality of load detection devices, the loads being detected by the respective load detection devices.

15. The rolling apparatus according to claim 3, further comprising:

a rolling direction force calculation device configured to calculate a rolling direction force by adding up loads of the one or more rolling direction force measurement devices each including the plurality of load detection devices, the loads being detected by the respective load detection devices.

* * * * *